US005478702A

United States Patent [19]

Kawai

[11] Patent Number: 5,478,702

[45] Date of Patent: Dec. 26, 1995

[54] METHOD FOR FORMING A COLOR IMAGE BY SCANNING EXPOSURE USING A PHOTOGRAPHIC MATERIAL CONTAINING A SPECIFIC PHENOL DERIVATIVE

[75] Inventor: Kiyoshi Kawai, Minami-ashigara, Japan

[73] Assignee: Fuji Photo Film Co., Ltd., Kanagawa, Japan

[21] Appl. No.: 470,022

[22] Filed: Jun. 6, 1995

Related U.S. Application Data

[63] Continuation of Ser. No. 287,793, Aug. 9, 1994, abandoned, which is a continuation of Ser. No. 104,906, Aug. 12, 1993, abandoned.

[30] Foreign Application Priority Data

Aug. 18, 1992 [JP] Japan ..... 4-241254

[51] Int. Cl.$^6$ ..... G03C 7/00; G03C 11/00; G03C 1/46; G03C 1/76

[52] U.S. Cl. ..... 430/363; 430/372; 430/504; 430/523; 430/551; 430/607; 430/963

[58] Field of Search ..... 430/363, 963, 430/523, 372, 504, 607, 551

[56] References Cited

U.S. PATENT DOCUMENTS

| | | | |
|---|---|---|---|
| 2,728,659 | 12/1955 | Loria et al. | 430/551 |
| 3,457,079 | 7/1969 | Koda et al. | 430/607 |
| 4,474,874 | 10/1984 | Hirano et al. | 430/372 |
| 4,587,210 | 5/1986 | Ono et al. | 430/551 |
| 4,789,624 | 12/1988 | Sakanoue et al. | 430/372 |
| 5,057,405 | 10/1991 | Shiba et al. | 430/363 |
| 5,270,158 | 12/1993 | Nakatsugawa et al. | 430/551 |
| 5,273,867 | 12/1993 | Shibuya et al. | 430/551 |

FOREIGN PATENT DOCUMENTS

| | | | |
|---|---|---|---|
| 350046 | 10/1990 | European Pat. Off. . | |
| 56-85748 | 7/1981 | Japan | 430/551 |
| 56-83742 | 7/1981 | Japan | 430/607 |
| 59-189342 | 10/1984 | Japan | 430/551 |
| 60-263149 | 12/1985 | Japan | 430/607 |
| 2-18548 | 1/1990 | Japan . | |
| 4-15645 | 1/1992 | Japan . | |
| 5-150431 | 6/1993 | Japan | 430/607 |
| WO8704534 | 7/1987 | WIPO . | |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

There is disclosed a method for forming a color image using a silver halide color photographic material having three silver halide photosensitive layers and a non-photosensitive layer, on a support, which comprises subjecting said photographic material wherein a compound represented by the formula (I) is contained in a non-photosensitive layer to scanning exposure with an exposure time being $10^{-4}$ sec or less per picture element, and processing said exposed photographic material with a color developer: formula (I)

wherein X represents a hydrogen atom, a hydroxyl group, an amino group, or a sulfonamido group, $R^{11}$ and $R^{12}$ each represent the group defined for X, or an alkyl group, an aryl group, an amido group, a ureido group, an alkylthio group, an arylthio group, an alkoxy group, or an aryloxy group, and $R^{13}$ represents a hydrogen atom, a halogen atom, a sulfo group, a carboxyl group, an alkyl group, an acyl group, an oxycarbonyl group, a carbamoyl group, a sulfonyl group, or a sulfamoyl group, provided that the molecular weight of the compound represented by formula (I) is 390 or more.

16 Claims, No Drawings

METHOD FOR FORMING A COLOR IMAGE BY SCANNING EXPOSURE USING A PHOTOGRAPHIC MATERIAL CONTAINING A SPECIFIC PHENOL DERIVATIVE

This is a Continuation of application Ser. No. 08/287,793 filed Aug. 9, 1994, now abandoned, which is a continuation of application Ser. No. 08/104,906 filed Aug. 12, 1993, now abandoned.

FIELD OF THE INVENTION

The present invention relates to a method for forming a high-image-quality color image by scanning exposure using high-intensity light, for example from a laser or a light-emitting diode, and to a silver halide photographic material which can be used in the method and which enables rapid production of a high-image-quality color image.

BACKGROUND OF THE INVENTION

In recent years, techniques for converting image information into electrical signals to be transmitted or stored or to be reproduced on a CRT have been extensively developed. Along with this, the demand for hard copies from such image information has increased, and various means of obtaining hard copies have been suggested. However, many of these hard copies are poor in image quality, and in particular the image quality of all color hard copies is not comparable with that of prints using current color papers. As means of providing a hard copy having high image quality, for example, Pictrography (trade name), which is manufactured by Fuji Photo Film Co., Ltd., and which uses an LED scanning exposure system as a system for the thermal development dye diffusion of a silver halide, can be mentioned.

On the other hand, due to the progress made in silver halide photographic materials and compact simple rapid-development systems (e.g., mini-lab systems), printed photographs of quite high image quality are supplied relatively easily and inexpensively in a short period of time. Therefore, there is very high demand for a hard copy material that can form high image quality as a hard copy of image information; that is inexpensive for such use; that can be processed simply and rapidly; and that can give stable performance.

In general, the method of obtaining a hard copy from electrical signals takes a scanning exposure system, wherein generally pieces of image information are successively picked up and exposed, and accordingly a photographic material suitable therefore is required. When a hard copy is to be obtained rapidly using a silver halide photographic material, it is required to shorten both the time of scanning exposure and the time of the development processing step. To shorten the time of scanning exposure, the exposure time per picture element has to be shortened as much as possible by using a light source high in output. It has become to be able to control the scanning exposure time in such a short time as $10^{-7}$ sec or below per picture element by advance of modulation controlling technique for scanning exposure light source. However, with respect to silver halide emulsion grains, it is well known that, as the exposure intensity becomes higher and the exposure time becomes shorter, development activity of the latent image formed by the exposure becomes weaker, the developing speed becomes slower, and the change of the photographic properties due to a change in the processing solution becomes greater. Further, in order to make the development processing step simple and rapid, it is required to use a silver halide emulsion that has a high silver chloride content, as described in WO 87/04534. However, the use of such a silver halide emulsion having a high silver chloride content results in a further increase in the change of the photographic properties due to a change in the processing solution with short, high-intensity exposure, in comparison with silver bromide emulsions and silver bromochloride emulsions that have a low silver chloride content. In addition, if the time of the development processing step is shortened further, the change of the photographic properties due to a change in the processing solution increases further. Further, it has been found that the fluctuation of photographic properties due to the changes of processing solutions is deteriorated by the lapse of time after coating of photographic material. As a result, in order to obtain a hard copy simply and rapidly with the performance constant at all times, a technique is required wherein the latent image formed from a silver halide emulsion having a high silver chloride content with high-intensity and short-time exposure is developed stably in as short a time period as possible.

As a light source for exposure of scanning exposure system recording apparatuses, for example, a glow lamp, a xenon lamp, a mercury lamp, a tungsten lamp, or a light-emitting diode is used conventionally. However, any of these light sources is attended with such practical defects as that the output is weak and the life is short. To circumvent these defects, there is a scanner that uses, as a light source for a scanning system, a coherent laser light source, for example a semiconductor laser or a gas laser, such as a He—Ne laser, an argon laser, and a He—Cd laser.

Gas lasers can provide high output, but they are attended with such defects as that they are large in size and expensive, and they require a modulator.

On the other hand, semiconductor lasers have such good points as that they are small in size and inexpensive; they can be modulated easily; and they have a longer life than gas lasers. The luminescence wavelength of these semiconductor lasers lies mainly in the range from the red region to the infrared region. When the semiconductor laser is used as a light source, the semiconductor laser may be used in two ways. One way combines a semiconductor laser with a non-linear optical element, to take out the visible second harmonics, so that a silver halide photographic material sensitized spectrally to visible radiation may be exposed to the light; the other way uses a semiconductor laser that can emit light ranging from red light to infrared light, so that a silver halide photographic material highly sensitive to the red/infrared region may be exposed to the light.

However, the conventional red/infrared-sensitive photographic material is unstable in latent image after exposure to light, and it is high in the change of photographic properties due to a change in the development processing, in comparison with photographic materials spectrally sensitized for blue/green. Further, in high-intensity exposure using a laser, the change of photographic properties due to a change in the development processing is increased further, and the change is far from optimal in practical application.

For such high-illumination scanning exposure, to minimize fluctuation of photographic properties due to changes in processing solutions, various techniques are known. For example, EP0350046 and JP-A ("JP-A" means unexamined published Japanese patent application) No. 18548/1990 disclose that, when silver halide emulsion grains high in silver chloride content are doped with metal ions (for example, ions of Fe, Rh, or Ir), fluctuation of photographic properties due to changes in processing solutions can be made small. Further, JP-A No. 15645/1992 discloses that, when a pivaloyl-type or benzoyl-type yellow coupler wherein the ortho position of the acetanilido in the molecule is substituted by an alkoxy group or the like is used, fluctuation of photographic properties due to changes in processing solutions can be made small. However, it cannot be said that even the use of these techniques is satisfactory, and the actual state is that the problem that fluctuation of photographic properties due to changes in processing solutions increases with the lapse of time during storage of unexposed photographic materials still remains unimproved.

SUMMARY OF THE INVENTION

Therefore the object of the present invention is to provide a method for forming an image that can provide a high-image-quality hard copy inexpensively and rapidly, and wherein fluctuation of photographic properties is improved against changes in development processing conditions (in particular the extent of fluctuation of photographic properties remains the same or is small against changes in development processing before and after the lapse of time during storage of undeveloped photographic materials).

Other and further objects, features, and advantages of the invention will appear more evident from the following description.

DETAILED DESCRIPTION OF THE INVENTION

It has been found that the above object of the present invention can be attained by adding, to a non-photosensitive layer, a specific phenol derivative whose molecular weight is substantially larger than that of a color mixing inhibitor used conventionally in an intermediate layer or a protective layer in a color photographic material for scanning exposure as disclosed, for example, in U.S. Pat. No. 5,057,405, leading to the completion of the present invention. Specifically, the above object of the present invention can be attained by a method for forming a color image using a silver halide color photographic material having, on a support, at least three silver halide photosensitive layers that are different in color sensitivity and that contain, respectively, couplers capable of forming yellow, magenta, and cyan and at least one non-photosensitive layer, which comprises subjecting said silver halide color photographic material, wherein at least one substantially colorless and non-color-forming compound represented by the formula (I) shown below is contained in at least one of the non-photosensitive layers of said silver halide color photographic material, to scanning exposure with the exposure time being $10^{-4}$ sec or less per picture element, and subjecting said exposed silver halide color photographic material to a color developing processing: formula (I)

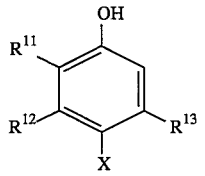

wherein X represents a hydrogen atom, a hydroxyl group, an amino group, or a sulfonamido group, $R^{11}$ and $R^{12}$ each represent the same group as that of X, or an alkyl group, an aryl group, an amido group, a ureido group, an alkylthio group, an arylthio group, an alkoxy group, or an aryloxy group, or $R^{11}$ and $R^{12}$ may together form a carbocyclic ring or a heterocyclic ring, when X represents a hydrogen atom, $R^{11}$ represents a hydroxyl group, an amino group, or a sulfonamido group, and $R^{13}$ represents a hydrogen atom, a halogen atom, a sulfo group, a carboxyl group, an alkyl group, an acyl group, an oxycarbonyl group, a carbamoyl group, a sulfonyl group, or a sulfamoyl group, provided that the molecular weight of the compound represented by formula (I) is 390 or more.

The object of the present invention can be attained more effectively in a method for forming a color image using a laser as a scanning exposure light source or a method for forming a color image using a semiconductor laser as a scanning exposure light source, in which method all the spectral sensitivity maximums of the three silver halide photosensitive layers that are different in color sensitivity are 550 nm or over.

The object of the present invention can be attained further more effectively by carrying out the exposure using a scanning exposure system wherein the exposure time is $10^{-7}$ sec or less per picture element.

Preferably, in the above method for forming a color image, the color development processing time is 25 sec or less, and the whole processing time involved from the start of the color development processing to the end of the drying process is 120 sec or less.

The present invention will be described below in more detail.

The compound represented by formula (I) used in the present invention will be described in more detail.

X represents a hydrogen atom, a hydroxyl group, an amino group (having 0 to 20 carbon atoms, e.g., amino), an alkylamino group, a dialkylamino group (e.g., diethylamino and dioctylamino), or an aliphatic or aromatic sulfonamido group (having 1 to 20 carbon atoms, e.g., methanesulfonamido, benzenesulfonamido, and 4-eicosiloxybenzenesulfonamido). $R^{11}$ and $R^{12}$ each represent the same group as that represented by X or an alkyl group (having 1 to 20 carbon atoms, e.g., a straight-chain, secondary, or tertiary alkyl group, other branched alkyl group, and a cycloalkyl group, such as methyl, t-butyl, hexadecyl, and 1-methyltridecyl), an aryl group (having 6 to 20 carbon atoms, e.g., phenyl, p-tolyl, or 4-dodecylphenyl), an aliphatic or aromatic amido group (having 1 to 20 carbon atoms, e.g., acetamido, benzoylamino, and 2-hexyldecanoylamino), a ureido group (having 0 to 20 carbon atoms, e.g., N-dimethylureido and N-hexadecylureido), an alkylthio group (having 1 to 20 carbon atoms, e.g., methylthio and decylthio), an arylthio group (having 6 to 20 carbon atoms, e.g., phenylthio and 4-t-octylphenylthio), an alkoxy group (having 1 to 20 carbon atoms, e.g., methoxy, butoxy, and tetradesiloxy), or an aryloxy group (having 6 to 20 carbon atoms, e.g., phenoxy and 4-methoxyphenoxy), and $R^{11}$ and $R^{12}$ may together form a carbocyclic ring (e.g., a naphthalene ring) or a heterocyclic ring (e.g., a 5- to 7-membered carbostyryl ring). $R^{13}$ represents a hydrogen atom, a halogen atom (e.g., fluorine, chlorine, and bromine), a sulfo group, a carboxyl group, an alkyl group (having 1 to 20 carbon atoms, e.g., methyl, t-butyl, hexadecyl, and 1-methyltridecyl), an acyl group (having 2 to 20 carbon atoms, e.g., acetyl, benzoyl, and octadecanoyl), an aliphatic or aromatic oxycarbonyl group (having 2 to 20 carbon atoms, e.g., methoxycarbonyl, phenoxycarbonyl, and 2-ethylhexyloxycarbonyl), an aliphatic or aromatic carbamoyl group (having 1 to 20 carbon atoms, e.g., N-butylcarbamoyl and N,N-dioctylcarbamoyl), an aliphatic or aromatic sulfonyl group (having 1 to 20 carbon atoms, e.g., methanesulfonyl, benzenesulfonyl, and dodecylbenzenesulfonyl), or a sulfamoyl group (having 0 to 20 carbon atoms, e.g., N,N-diethylsulfamoyl and N-octadecylsulfamoyl).

The alkyl group (residue group), the aryl group (residue group), the amino group (residue group), the sulfonyl group (residue group), etc. in the above substitutents X, $R^{11}$ $R^{12}$ and $R^{13}$ may further be substituted. As the further substituent, for example, an alkyl group, an aryl group, an amido group, an alkylthio group, an arylthio group, an alkoxy group, an aryloxy group, an oxycarbonyl group, a carbamoyl group, an acyloxy group, an acyl group, a sulfonamido group, a sulfamoyl group, a sulfonyl group, a heterocyclic group, a hydroxyl group, a halogen atom, a cyano group, a nitro group, a sulfo group, a carboxyl group, and an amino group can be mentioned, but the present invention is not limited to them.

The compound represented by formula (I) is a compound capable of undergoing a redox reaction with the oxidized product of a color developing agent.

Out of the compounds represented by formula (I), those represented by the following formula (II) are preferable: formula (II)

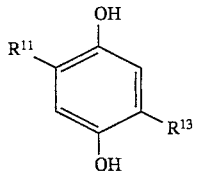

wherein $R^{11}$ and $R^{13}$ have the same meanings as defined above in formula (I), provided that the molecular weight of the compound is 390 or more.

In formulas (I) and (II), preferably X, $R^{11}$, $R^{12}$ and $R^{13}$ are those given below. Preferably X is a hydroxyl group. Preferably $R^{11}$ includes an alkyl group, an amido group, an alkylthio group, and an alkoxy group. Preferably $R^{12}$ is a hydrogen atom. Preferably $R^{13}$ includes a hydrogen atom, an alkyl group, a halogen atom, a carbamoyl group, and a sulfonyl group. Preferably the alkyl group represented by $R^{11}$ and $R^{13}$ includes a secondary alkyl group and a tertiary alkyl group. Preferably the molecular weight of the compounds (monomers) of formulas (I) and (II) is 430 or over, more preferably 500 or over. There is no particular restriction on the upper limit of the molecular weight of the monomer, but preferably the upper limit of the molecular weight is 1000 or less from an economical point of view. The compound represented by formula (I) may be in the form of a dimer or more higher polymer (e.g., a vinyl polymer and a condensation polymer). In the case of a dimer, preferably the molecular weight is 780 or higher and in the case of a more higher polymer, preferably the molecular weight is 1000 or higher.

Specific examples of the compounds represented by formulas (I) and (II) are shown below, but the present invention is not restricted to them.

M.W. means a molecular weight.

SV-1

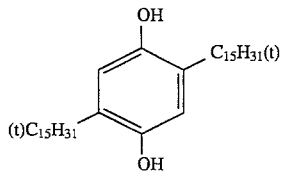

M.W. = 530.9

SV-2

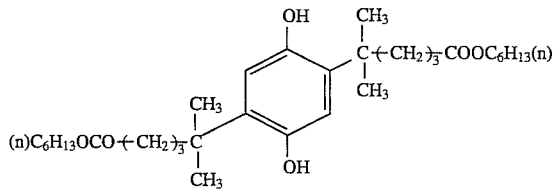

M.W. = 534.8

SV-3

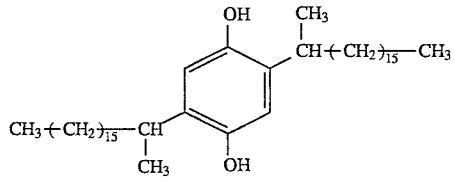

M.W. = 615.1

-continued
SV-4
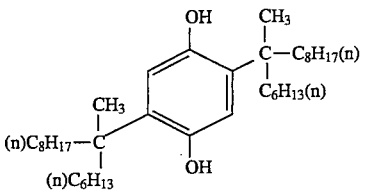
M.W. = 559.0
SV-5
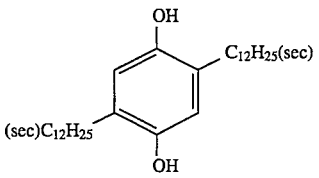
M.W. = 446.8
SV-6
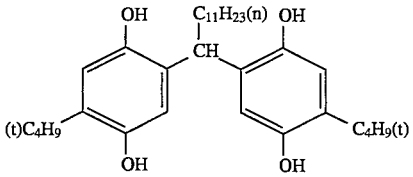
M.W. = 498.8
SV-7
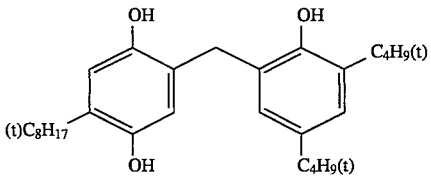
M.W. = 440.7
SV-8
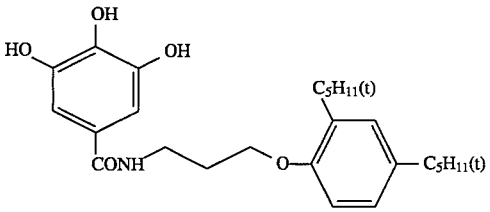
M.W. = 443.6
SV-9
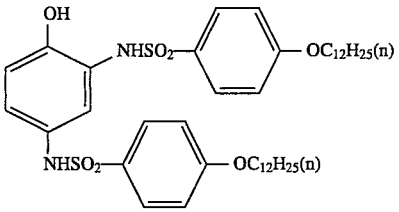
M.W. = 773.1
SV-10
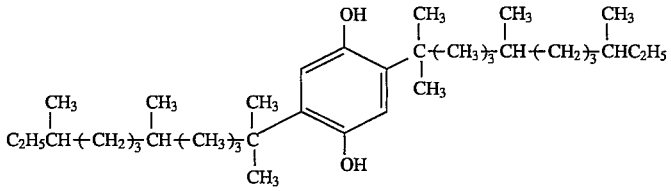

-continued
M.W. = 530.9
SV-11
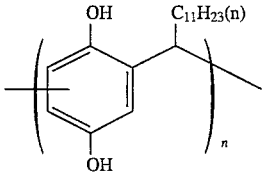
Average M.W.: ca. 3,000
SV-12
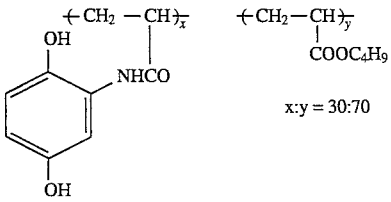
Average M.W.: ca. 30,000
SV-13
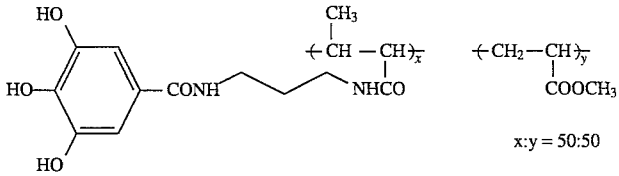
Average M.W.: = ca. 10,000
SV-14
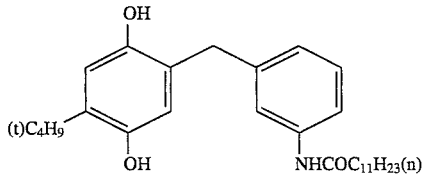
M.W. = 453.6
SV-15
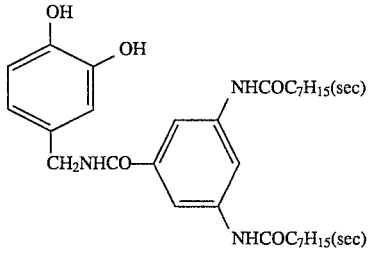
M.W. = 525.7
SV-16
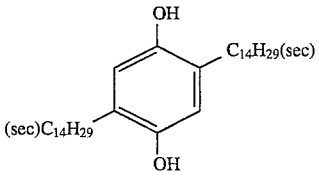
M.W. = 502.8

-continued
SV-17
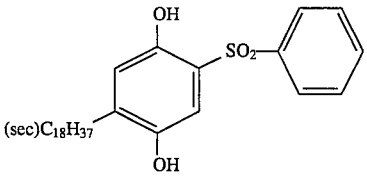
M.W. = 502.8
SV-18
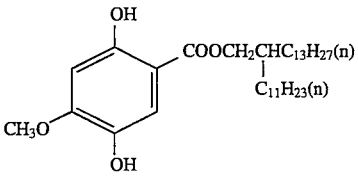
M.W. = 548.9
SV-19
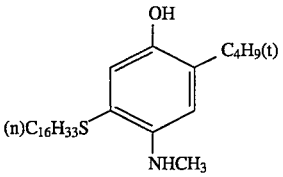
M.W. = 435.8
SV-20
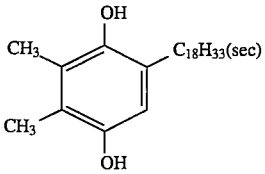
M.W. = 390.7
SV-21
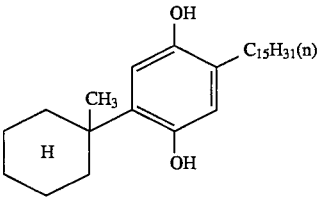
M.W. = 416.7
SV-22
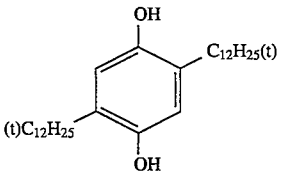
M.W. = 446.8
SV-23
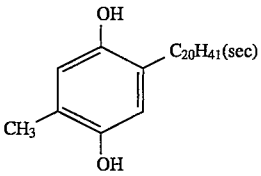
M.W. = 404.7

-continued
SV-24
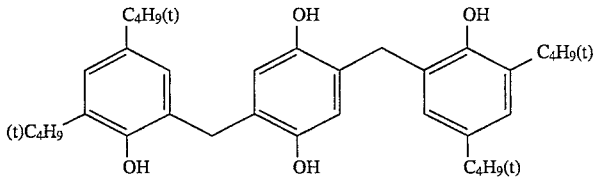
M.W. = 546.8
SV-25
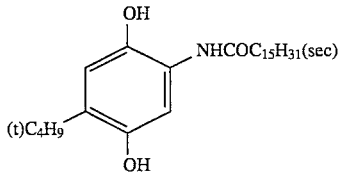
M.W. = 419.7
SV-26
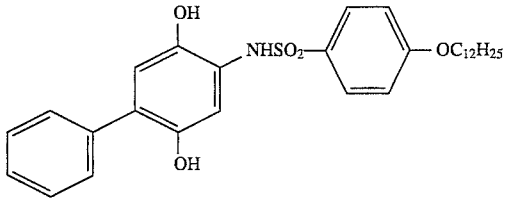
M.W. = 525.7
SV-27
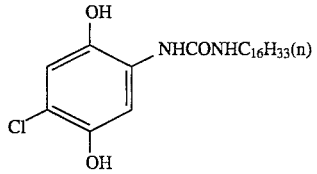
M.W. = 422.0
SV-28
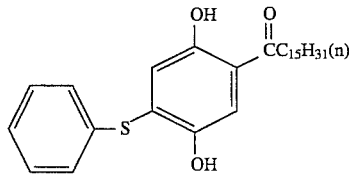
M.W. = 456.6
SV-29
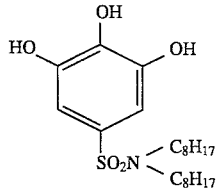
M.W. = 429.6
SV-30
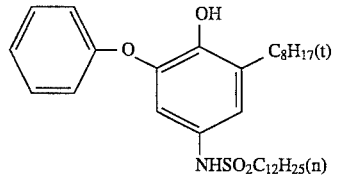
M.W. = 545.8

The compounds represented by formulas (I) and (II) according to the present invention can be synthesized in accordance with methods described, for example, in JP-B ("JP-B" means examined Japanese patent publication) Nos. 12250/1976 and 13748/1986 and JP-A Nos. 22237/1982, 21249/1983, 156932/1983, and 5247/1984.

The amount of the compound represented by formula (I) to be used in a layer is preferably 0.05 to 2 mmol/$m^2$ more preferably 0 1 to 1 mmol/$m^2$. If the compound is used in several layers, preferably each layer contains the above amount.

As the silver halide emulsion used in the present invention, can be mentioned silver chloride, silver bromide, silver chloro(iodo)bromide, and silver iodobromide. In particular, in the present invention, grains comprising silver chloride or silver bromochloride substantially free from silver iodide are preferably used in order to make the development processing time shortened. Herein, the expression "substantially free from silver iodide" means that the silver iodide content is 1 mol % or below, preferably 0.2 mol % or below. On the other hand, high-silver-chloride grains containing 0.01 to 3 mol % of silver iodide on the emulsion surface, as described in JP-A No. 84545/1991, are preferably used for the purpose of heightening the adaptability to high-intensity exposure, increasing the sensitivity to infrared spectral sensitization, or heightening the stability. The halogen composition of the emulsion may be the same or different from grain to grain and if the halogen composition of the emulsion is the same from grain to grain, the properties of the grains may be made uniform easily among the grains. With respect to the halogen composition distribution in the silver halide emulsion grains, for example, grains having a so-called uniform structure, wherein the composition of any part of the silver halide grains is the same, or grains having a so-called laminated structure, wherein the halogen composition of the core in the silver halide grains is different from that of the shell (consisting of a layer or layers) surrounding the core, or grains having a structure wherein there are non-layered parts in the grain or on the surface of the grain where the halogen composition is different from part to part (if these parts are on the surface of the grain, the structure is such that the parts different in composition are joined to the edges, corners, or the planes of the grain), may be suitably selected for use. To obtain high sensitivity, the use of one of the latter two is more advantageous than the use of grains having a uniform structure, and is preferable in consideration of the pressure resistance. When the silver halide grains have the above structures, the boundary of parts that differ in halogen composition may be a distinct boundary, or an obscure boundary where mixed crystal is formed due to the difference in composition, or a boundary where the structure is changed continuously positively.

For a photographic material suitable for rapid processing, as in the present invention, a so-called high-silver halide emulsion, wherein the silver chloride content is high, is preferably used. In the present invention, preferably the silver halide content of the high-silver chloride emulsion is 95 mol % or more, more preferably 97 mol % or more.

In such a high-silver halide emulsion, preferably the structure is such that the silver bromide localized phase, which may be in the form of a layer or non-layer, is present in the silver halide grain and/or on the surface of the silver halide grain. The composition of such a localized phase is such that preferably the silver bromide content is at least 10 mol % or more, more preferably 20 mol % or more. The silver bromide content in the silver bromide-localized layer can be determined by an analysis using X-ray diffraction method (e.g., as described in *Shin-jikken Kagakukoza No.* 6, *Kozokaiseki*, edited by Nihon Kagakukai, published by Maruzen), or the like. The localized phase may be present in the grain, or at the edges or corners on the surface of the grain, or on the planes of the grains, and, as one preferable example, localized phases that are epitaxially grown on the corners of the grain can be mentioned.

For the purpose of lowering the replenishing amount of the development processing liquid, it is also effective to further increase the silver halide content of the silver halide emulsion. In such a case, an emulsion comprising approximately pure silver chloride, wherein the silver halide content is 98 to 100 mol %, is preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 μm to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chlorbromide emulsion used in the present invention can be prepared by methods described, for example, by P. Glafkides, in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

The localized phase of the silver halide grain of the present invention or its substrate preferably contains different metal ions or their complex ions. In the localized phase, use will be made of mainly ions selected from iridium ions, rhodium ions, iron ions, etc. or their complex ions, and in the substrate, use will be made of mainly metal ions selected from osmium ions, iridium ions, rhodium ions, platinum ions, ruthenium ions, palladium ions, cobalt ions, nickel ions, iron ions, etc. or their complex ions in combination. The localized phase and the substrate may be different in the type of metal ions and in the concentration of metal ions. Two or more types of these metals can be used.

As in the present invention, the silver halide emulsion used for photographic materials for scanning exposure by a laser or the like is suitable for high-intensity exposure, and the required gradation is such that the needed density can be obtained in the exposure control range of the laser. Further, if an infrared semiconductor laser is used, infrared spectral sensitization is required and it is required to improve the preservability of image. To these ends, it is very useful to use, out of the above metal ions, particularly ions or complex ions of iridium, rhodium, ruthenium, or iron. Although the amount of these ions or complex ions to be used varies considerably depending, for example, on the silver halide emulsion composition, the size, and the doped position of the doped substrate, iridium or rhodium ion used is preferably in an amount of $5\times10^{-9}$ to $1\times10^{-4}$ mol per mol of silver, and iron ion used is used preferably in an amount of $1\times10^{-7}$ to $5\times10^{-3}$ mol per mol of silver.

These metal-ion-providing compounds are incorporated into the localized phase and/or other grain section (substrate) of the silver halide grains of the present invention, for example, in such a way that they are added into an aqueous gelatin solution serving as a dispersion medium, into an aqueous halide solution, into an aqueous silver salt solution, or into another aqueous solution; or they are added in the form of silver halide fine particles, wherein they are previously incorporated and these fine particles are dissolved.

As to incorporation of metal ions to be used in the present invention into emulsion grains, it is carried out before, during, or immediately after the formation of the grains. This can be changed depending on where the metal ions are to be positioned in the grains.

Generally the silver halide emulsion to be used in the present invention is chemically and spectrally sensitized.

With respect to the chemical sensitization, for example, chemical sensitization using a chalcogen sensitizer (in particular, sulfur sensitization, wherein typically an unstable sulfur compound is added; selenium sensitization by a selenium compound; and tellurium sensitization by a tellurium compound, can be mentioned), noble metal sensitization, represented by gold sensitization, or reduction sensitization, can be used alone or in combination. Concerning compounds used in chemical sensitization, those described in JP-A No. 215272/1987, page 18, the right lower column, to page 22, the right upper column, can be preferably used.

The emulsion to be used in the present invention is a so-called surface latent image type emulsion, wherein a latent image is mainly formed on the grain surface.

To the silver halide emulsion to be used in the present invention, various compounds or their precursors can be added for the purpose of preventing fogging in the step of producing the photographic material, or during the storage of the photographic material, or during the photographic processing, or for the purpose of stabilizing the photographic performance. As specific examples of these compounds, those described in the above-mentioned JP-A No. 215272/1987, pages 39 to 72, can be preferably used. Also 5-arylamino-1,2,3,4-thiatriazole compounds (the aryl residue has at least one electron-attracting group) described in EP0447647 can be preferably used.

The spectral sensitization is carried out for the purpose of rendering the emulsion of each layer of the photographic material of the present invention spectrally sensitive to a desired wavelength region of light. In the present invention, for the exposure to light, it is intended to use monochromatic high-intensity light, for example, of a laser or LED, and it is required that the spectral sensitization is carried out in conformity with the wavelength of the light fluxes. The expression "to carry out spectral sensitization in conformity with the light fluxes" means to carry out spectral sensitization that uses a sensitizing dye having spectral sensitization in the wavelength of those light fluxes, and it does not necessarily mean that the sensitivity maximum of the spectral sensitization only coincides with the wavelength of those light fluxes. In view of the sensitivity and color separation by these light fluxes, although it is preferable that the wavelength of the light fluxes and the maximum wavelength of the spectral sensitivity coincide, preferable design is also such that the wavelength of the light flux is intentionally shifted from the maximum wavelength of the spectral sensitivity for the purpose of reducing the change in sensitivity due to a change, for example, in the wavelength and intensity of the laser caused by a change in the temperature. In the present invention, it is also preferable to add a dye for absorbing light in the wavelength region corresponding to the intended spectral sensitivity (a spectral sensitizing dye) to a photosensitive layer other than the photosensitive layers subject to the present invention. As the spectral sensitizing dyes used for such spectral sensitization, for example, those described by F. M. Harmar in *Heterocyclic compounds-Cyanine dyes and related compounds* (John Wiley & Sons, New York, London, 1964) can be mentioned. Specific examples of the compounds and methods of spectral sensitization are described in the above-mentioned JP-A No. 215272/1987, page 22, the right upper column, to page 38, and these are preferably used.

In the present invention, if a laser is used as a light source for digital exposure, the green to the infrared region, mainly the red to the infrared region, is required to be spectrally sensitized effectively. In particular, if the region of 730 nm or over is to be spectrally sensitized, sensitizing dyes described in JP-A No. 15049/1991, page 12, the left upper column, to page 21, the left lower column; in JP-A No. 20730/1991, page 4, the left lower column, to page 15, the left lower column; in EP0420011, page 4, line 21, to page 6, line 54; in EP0420012, page 4, line 12, to page 10, line 33; in EP0443466, and in U.S. Pat. No. 4,975,362, are preferably used. These sensitizing dyes are characterized in that they are chemically relatively stable; they can be absorbed relatively strongly onto the surface of silver halide grains, and they firmly resist desorption by coexistent dispersed substances, such as couplers. As the sensitizing dyes for infrared sensitization, particularly compounds whose reduction potential is −1.05 (VvsSCE) or a value more negative than that are preferable, and more particularly compound whose reduction potential is −1.10 or a value more negative than that are preferable. Sensitizing dyes having this property are advantageous for high sensitization, in particular for stabilization of sensitivity and latent images.

The measurement of reduction potential can be carried out by phase discrimination secondary higher harmonics AC polarography. As the working electrode, a dropping mercury electrode; as the reference electrode, a saturated calomel electrode; and as the auxiliary electrode, platinum, are used.

The measurement of reduction potential by phase discrimination secondary higher harmonics AC voltammetry using platinum as a working electrode is described in

*Journal of Imaging Science*, Vol. 30, pages 27 to 35 (1986).

To incorporate these spectral sensitizing dyes into the silver halide emulsion, these dyes may be directly dispersed into the emulsion, or they may be dissolved in a solvent or a mixture of solvents, such as water, methanol, ethanol, propanol, butanol, methyl Cellosolve, and 2,2,3,3-tetrafluorobutanol, which combinations are then added to the emulsion. Also they may be made into an aqueous solution together with an acid or base, as described in JP-B Nos. 23389/1969, 27555/1969, and 22089/1982, or they may be made into an aqueous solution or colloid dispersion together with a surface-active agent, as described in U.S. Pat. Nos. 3,822,135 and 4,006,025, and the obtained aqueous solution or colloid dispersion may be added to the emulsion. Also, they may be dissolved in a solvent substantially immiscible with water, such as phenoxyethanol, and then dispersed into water or a hydrophilic colloid, and the finally are added to the emulsion. Also they may be directly dispersed into a hydrophilic colloid, as described in JP-A Nos. 102733/1978 and 105141/1983, and the dispersion may be added to the emulsion. The time when the spectral sensitizing dyes are added to the emulsion is that of any known useful step among steps of preparing the emulsion. That is, they are added at any time selected from the time before or during the formation of the grains of the silver halide emulsion, the time before the washing step immediately before the formation of the grains, the time before or during the chemical sensitization, the time immediately after the chemical sensitization and before the cooling and solidification of the emulsion, and the time for preparing the coating liquid. Although most commonly they are added after the completion of the chemical sensitization and before the coating, they may be added at the time when a chemical sensitizer is added, as described in U.S. Pat. Nos. 3,628,969 and 4,225,666, to carry out spectral sensitization and chemical sensitization simultaneously; or the spectral sensitization can be carried out prior to chemical sensitization, as described in JP-A No. 113928/1983, or they can be added before the completion of the formation of the deposit of silver halide grains to start the spectral sensitization. The spectral sensitizing dye may be added in portions; that is to say, it is possible to add a part of the spectral sensitizing dye prior to chemical sensitization and the remaining part after the chemical sensitization; and also the spectral sensitizing dye may be added at any time during the formation of the silver halide grains, for example by a method disclosed in U.S. Pat. No. 4,183,756. Among these, in particular, the spectral sensitizing dye is preferably added in the step of washing the emulsion or before chemical sensitization.

The amount of these spectral sensitizing dyes to be added varies widely depending on the case, and is preferably in the range of $0.5\times10^{-6}$ mol to $1.0\times10^{-2}$ mol, more preferably $1.0\times10^{-6}$ to $5.0\times10^{-3}$ mol, per mol of the silver halide.

In the present invention, particularly if a sensitizing dye having a spectral sensitizing sensitivity in the range from the red region to the infrared region is used, it is preferable to use compounds described in JP-A No. 157749/1990, page 13, the right lower column, to page 22, the right lower column. Use of these compounds can increase the preservability of the photographic material, the stability of the processing, and the effect of the supersensitization in a unique manner. In particular, the use of a combination of compounds of formulas (IV), (V), and (VI) as described in the above JP-A No. 157749/1990 is particularly preferable. These compounds are used in an amount of $0.5\times10^{-5}$ to $5.0\times10^{-2}$ mol, more preferably $5.0\times10^{-5}$ to $5.0\times10^{-3}$ mol, per mol of the silver halide, and a favorable molar ratio of the compounds to be used to the sensitizing dye is in the range of from 1 to 10,000, preferably from 2 to 5,000.

The constitution of the present photographic material will now be described. It is required that the present photographic material has, on the support, at least three silver halide emulsion layers different in color sensitivity, and at least one layer of said layers contains a cyan coupler of the present invention. The present photographic material is used in digital scanning exposure using a monochromatic high-intensity light, for example, a gas laser, a light-emitting diode, a semiconductor laser or a second-harmonics generating apparatus comprising a combination of a nonlinear optical element with, a semiconductor or a solid state laser. To make the system compact and inexpensive, the use of a secondary higher harmonics generating apparatus comprising of a combination of a nonlinear optical element with a semiconductor laser or a semiconductor laser/solid state laser is preferable. In particular, to design a compact, inexpensive, and stable apparatus having a long life, the use of a semiconductor laser is preferable. To use a semiconductor laser, preferably, at least two layers have a spectral sensitivity maximum of 670 nm or over. This is because the light emission wavelength region of inexpensive stable semiconductor lasers now available is only in the range of from the red region to the infrared region. However on the laboratory level, oscillation of semiconductor lasers in the green region or the blue region is confirmed, and it is well expected that when the technique for producing semiconductors is advanced, these semiconductor lasers will be used inexpensively and stably. In that case, the necessity that at least two layers have a spectral sensitivity maximum of 670 nm or over is reduced.

The spectral sensitivity maximum of the photographic material can be arbitrarily set by the wavelength of the light source used for scanning exposure. In the case of an SHG light source obtained by a combination of a nonlinear optical crystal with a semiconductor laser or a solid laser using a semiconductor laser for an excited light source, since the generated wavelength of the laser can be halved, blue light and green light can be obtained. Accordingly, it is generally possible that the maximums of the spectral sensitivities of a photographic material are present in three regions, that is, the blue region, the green region, and the red region. If a semiconductor laser is used for a light source, in order to make the apparatus inexpensive, high in safety, and compact, preferably at least two layers have spectral sensitivity maximums at 670 nm or over. This is because the light-emitting wavelength region of presently available, inexpensive, and stable III-V-group-type semiconductor lasers is only in the red region to the infrared region. However, at the laboratory level, emission from II-VI-group-type semiconductor lasers in the green region and the blue region is confirmed, and it is well expected that these semiconductor lasers can be used inexpensively and stably if the technique of manufacturing the semiconductor lasers is advanced. In that event, the necessity that at least two layers have spectral sensitivity maximums at 670 nm or over will become small.

Preferably, photosensitive layers of the present photographic material include, on a support, three silver halide photosensitive layers that are different in color sensitivity, and each of the layers contains one of couplers capable of undergoing a coupling reaction with the oxidized product of an aromatic amine compound to form yellow, magenta, or cyan. Although the three different spectral sensitivity maximums can be selected by the wavelength of the light source used for the digital exposure, preferably the adjacent spectral sensitivity maximums differ from each other by at least 30 nm. There is no particular restriction on the corresponding relationship of color-forming couplers (Y, M, and C) contained in these photosensitive layers (λ1, λ2, and λ3) that have at least three different spectral sensitivity maximums. That is, although there are 3×2=6 possible combinations, in some cases, the layer photosensitive to the longest wavelength is preferably a yellow colorforming layer, in view of the resolving power of the human eye. Although there is no particular restriction on the order of the photosensitive layers that have at least three different spectral sensitivity maximums to be applied on a support, in some cases, preferably the photosensitive layer containing silver halide grains whose average size is greatest is placed on top, in view of rapid processing. Further, in some cases, preferably the photosensitive layer having spectral sensitivity to the longest wavelength is placed on top in view of sharpness. Further, in some cases, preferably the lowest layer is a magenta color-forming layer, in view of the preservability of hard copies under exposure to light or the like. The three different spectral sensitivities, the three color-forming couplers, and the order of layers lead therefore to 36 possible combinations. The present invention can be used effectively for these 36 photographic materials. Table 1 shows specific examples of digital exposure light sources, spectral sensitivity maximums, and color-forming couplers, which do not restrict the invention.

TABLE 1

| | Digital Scanning Exposure Light Source | | | Spectral |
|---|---|---|---|---|
| | Light Source | Wave-length (nm) | Color Formed** | Sensitivity Maximum (nm) |
| 1 | AlGaInAs (670) | 680 | C | 670 |
| | GaAlAs (750) | 750 | Y | 730 |
| | GaAlAs (810) | 810 | M | 810 |
| 2 | AlGaInAs (670) | 670 | Y | 680 |
| | GaAlAs (750) | 750 | M | 750 |
| | GaAlAs (830) | 830 | C | 840 |
| 3 | AlGaInAs (670) | 670 | M | 670 |
| | GaAlAs (750) | 750 | C | 750 |
| | GaAlAs (810) | 810 | Y | 820 |
| 4 | AlGaInAs (670) | 680 | Y | 670 |
| | GaAlAs (780) | 780 | C | 780 |
| | GaAlAs (830) | 830 | M | 840 |
| 5 | AlGaInAs (633) | 633 | Y | 630 |
| | AlGaInAs (680) | 680 | M | 670 |
| | GaAlAs (780) | 780 | C | 780 |
| 6 | GaAlAs (780) | 780 | M | 780 |
| | GaAlAs (830) | 830 | Y | 830 |
| | GaAlAs (880) | 880 | C | 880 |
| 7 | YAG + SHG* (KNbO3) | 473 | Y | 470 |
| | YVO4 + SHG* (KTP) | 532 | M | 550 |
| | AlGaInAs (680) | 680 | C | 700 |
| 8 | GaAs (900) + SHG* | 450 | M | 450 |
| | InGaAs (1200) + SGH* | 600 | C | 580 |
| | AlGaInAs (680) | 680 | Y | 700 |
| 9 | LED (580) | 580 | C | 580 |
| | LED (670) | 670 | M | 670 |
| | LED (810) | 810 | Y | 810 |

Note; *SHG: Secondary higher harmonics utilizing a nonlinear optical element
**The order of color-forming layers is not specifically restricted.

Exposure in the present invention will now be described. The photographic material of the present invention is intended to be used for scanning-type digital exposure, wherein an image is exposed to light by moving a high-intensity beam light relative to the photographic material, and the high-intensity beam is from an LED or a second-harmonics-generating light source (as a nonlinear optical element for generating second-harmonics, any of those described in "Optoronics" (1990) No. 12, pages 55, et seq., or JP-A No. 032769/1990 can be used) made up of a combination of a nonlinear optical crystal with a semiconductor laser, or a solid laser using a semiconductor laser as an exciting light source, or a semiconductor laser, or a gas laser. Therefore, the time for which the silver halide in the photographic material is exposed to light is the time required to expose a certain tiny area to light. As this tiny area, generally, a minimum unit, in which the amount of light from each digital datum is controlled, is used, and that unit is called a picture element. Therefore, the exposure time per picture element changes depending on the size of the picture element. The size of the picture element is dependent on the picture element density, and the actual range of the size of the picture element is 50 to 2000 dpi. If the exposure time is defined as the time required to expose a picture element size having a picture element density of 400 dpi to light, preferably the exposure time is $10^{-4}$ sec or less but $10^{-10}$ sec or more, preferably $10^{-7}$ sec or less.

Now, the control of the amount of light of the scanning exposure light source preferably used in the present invention will be described.

In the case wherein an image having gradation, such as a hard copy including a pictorial image, is formed on a support as intended by the present invention, it is required to modulate the amount of light in several stages (at least in 6 bit preferably at least in 8 bit) in order to obtain a satisfactory image quality. In the case of a semiconductor laser, the modulation method includes an intensity modulation system, wherein light intensity is changed by changing the electric current of a laser, and a pulse modulation system, wherein light intensity of a laser is constant and the exposure time per picture element is changed to change the amount of light, and these two systems are used singly or in combination. Since, in the intensity modulation system, the light intensity of a laser is changed, the amount of generated heat of the laser element changes with the exposure amount, and therefore, in comparison with the pulse width modulation system, the light intensity is difficult to control, and the controllable minimum time per picture element becomes longer in comparison with that of the pulse width modulation system. Thus, preferably a pulse modulation system is used. Even in that case, actually, it is difficult for the modulation time per picture element to be made shorter than several hundreds ns, because of problems involving safety of modulation.

If the modulation is to be fast, preferably an external modulator is used. By using of an external modulator, the modulation speed can be brought to a maximum of several ns per picture element.

The external light modulator that can be used in the present invention includes, for example, a bulk-type acousto-optic modulator, a waveguide-type acousto-optic modulator, and a waveguide-type electro-optic modulator. The bulk-type acousto-optic modulator is described in detail in "Hikari Electronics no Kiso" (written by Ammon Yariv and jointly translated by Kunio Tada and Takeshi Kamiya (Maruzen)). The waveguide-type acousto-optic modulator is described in detail, for example, in JP-A No. 127026/1991 and "Hikari Shuseki Kairo," jointly written by Nishihara, Haruna, and Saihara, and published by Ohmu-sha (1985). The waveguide-type electro-optical modulator is described in JP-A No. 931/1990 and the above book "Hikari Shuseki Kairo."

In particular, in view, for example, of the leading speed of the modulator, a waveguide-type acousto-optic modulator and a waveguide electro-optic modulator are preferably used.

In the photographic material of the present invention, preferably, for the purpose, for example, of preventing irradiation or halation or improving safelight immunity, to the hydrophilic colloid layer are added dyes that are described in European Patent No. 0337490A2, pages 27 to 76, and these dyes can be decolored by processing (e.g., an oxonol dye and a cyanine dye). Dyes to be incorporated in a hydrophilic colloid layer in the state of dispersed solid fine particles and are decolored by development processing, described in JP-A No. 282244/1990, page 3, the right upper column, to page 8, and also described in JP-A No. 7931/1991, page 3, the right upper column, to page 11, the left lower column, can be preferably used. When these dyes are used, preferably dyes are selected and used which have absorption overlapping with the spectral sensitivity maximum of the longest-wavelength photosensitive layer. Preferably, using these dyes, the optical exposure (the logarithm of the reciprocal of the transmitted light) (the reflection density in the case of a reflective base) in the laser wavelength of the particular photographic material is made to be 0.5 or more with a view to improving sharpness.

Some of these water-soluble dyes deteriorate the color separation if the amount of them to be used is increased. As dyes that can be used without deteriorating the color separation, water-soluble dyes described in Japanese patent application Nos. 310143/1991, 310189/1991, and 310139/1991 are preferred.

To improve the sharpness further, it is preferable to incorporate, into the water-resistant resin layer of the base, 12 wt % or more (more preferably 14 wt % or more) of titanium oxide, whose surface has been treated with a dihydric to tetrahydric alcohol (e.g., trimethylolmethane).

It is preferable to provide a hydrophilic colloid layer containing a white pigment between the support and the photosensitive layer most adjacent to the support. In this case, the coating weight of white pigment to be required is 2 g/m$^2$ or more, preferably 4 g/m$^2$ or more, more preferably 8 g/m$^2$. There is no particular upper limit but preferably the coating amount is 40 g/m$^2$ or below. Herein, the term "weight of white pigment" includes the weights of various surface active agents or dispersion stabilizers when the white pigment contains them in order to improve, for example, the dispersibility thereof. Although the ratio of the white pigment to the hydrophilic binder in the hydrophilic colloidal layer containing the white pigment can arbitrarily be set in the range satisfying the above conditions, the ratio of the white pigment is 10 wt % or more, preferably 20 wt % or more, more preferably 40 wt % or more, and most preferably 70 wt % or more. Although there is no particular upper limit, the ratio is preferably 99 wt % or less in view of film strength.

Further, colloidal silver is preferably used in an antihalation layer, as described in, for example JP-A No. 239544/1989.

As a binder or protective colloid that can be used in the photographic material according to the present invention, gelatin is advantageously used, but some other hydrophilic colloid can be used alone or in combination with gelatin. As a gelatin, preferably low-calcium gelatin having a calcium content of 800 ppm or less, more preferably 200 ppm or less, is used. In order to prevent various fungi or bacteria from propagating in the hydrophilic colloid layer to deteriorate the image quality, preferably a mildew-proofing agent, as described in JP-A No. 271247/1988, is added.

As a support to be used for the photographic material of the present invention, a white polyester support for display may be used, or a support wherein a layer containing white pigment is provided on the side that will have a silver halide layer. Further, in order to improve sharpness, preferably an antihalation layer is applied on the side of the support where the silver halide layer is applied or on the undersurface of the support. In particular, preferably the transmission density of the base is set in the range of 0.35 to 0.8, so that the display can be appreciated through either reflected light or transmitted light.

As a support to be used for the photographic material of the present invention, a transparent base is also preferably used. In this case, preferably an antihalation layer is applied on the side of the support or on the under surface of the support.

The exposed photographic material may be subjected to conventional color processing, and in a case of a color photographic material of the present invention, after color development processing it is preferably bleached and fixed for the purpose of rapid processing. In particular, when the above-mentioned high-silver-chloride emulsion is used, the pH of the bleach-fix solution is preferably about 6.5 or below, more preferably about 6 or below, for the purpose of he acceleration of desilvering.

In the present invention, preferably the color development processing time is substantially within 25 sec. Herein the expression "substantially within 25 sec" refers to the period from the time when the photographic material is introduced into the developer tank to the time when the photographic material enters the next tank, including the crossover time in the air during movement from the developer tank to the next tank.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, those described in below-mentioned patent publications, particularly in European Patent No. 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p.10 upper right column line 6 to p.12 lower left column line 5, and p.12 lower right column line 4 from the bottom to p.13 upper left column line 17 | p.28 upper right column line 16 to p.29 lower right column line 11 and p.30 lines 2 to 5 | p.45 line 53 to p.47 line 3 and p.47 lines 20 to 22 |

-continued

| Element constituting photographic material | JP-A No. 215272/1987 | JP-A No. 33144/1990 | EP 0,355,660A2 |
|---|---|---|---|
| Solvent for silver halide | p.12 lower left column line 6 to 14 and p.13 upper left column line 3 from the bottom to p.18 lower left column last line | — | — |
| Chemical sensitizing agent | p.12 lower left column line 3 from the bottom to lower right column line 5 from the bottom and p.18 lower right column line to p.22 upper right column line 9 from the bottom | p.29 lower right column line 12 to last line | p.47 lines 4 to 9 |
| Spectral sensitizing agent (method) | p.22 upper right column line 8 from the bottom to p.38 last line | p.30 upper left column lines 1 to 13 | p.47 lines 10 to 15 |
| Emulsion stabilizer | p.39 upper left column line 1 to p.72 upper right column last line | p.30 upper left column line 14 to upper right column line 1 | p.47 lines 16 to 19 |
| Developing accelerator | p.72 lower left column line 1 to p.91 upper right column line 3 | — | — |
| Color coupler (Cyan, Magenta, and Yellow coupler) | p.91 upper right column line 4 to p.121 upper left column line 6 | p.3 upper right column line 14 to p.18 upper left column last line and p.30 upper right column line 6 to p.35 lower right column line 11 | p.4 lines 15 to 27, p.5 line 30 to p.28 last line, p.45 lines 29 to 31 and p.47 line 23 to p.63 line 50 |
| Color Formation-strengthen agent | p.121 upper left column line 7 to p.125 upper right column line 1 | — | — |
| Ultraviolet absorbing agent | p.125 upper right column line 2 to p.127 lower left column last line | p.37 lower right column line 14 to p.38 upper left column line 11 | p.65 lines 22 to 31 |
| Discoloration inhibitor (Image-dye stabilizer) | p.127 lower right column line 1 to p.137 lower left column line 8 | p.36 upper right column line 12 to p.37 upper left column line 19 | p.4 line 30 to p.5 line 23, p.29 line 1 to p.45 line 25 p.45 lines 33 to 40 and p.65 lines 2 to 21 |
| High-boiling and/or low-boiling solvent | p.137 lower left column line 9 to p.144 upper right column last line | p.35 lower right column line 14 to p.36 upper left column line 4 | p.64 lines 1 to 51 |
| Method for dispersing additives for photograph | p.144 lower left column line 1 to p.146 upper right column line 7 | p.27 lower right column line 10 to p.28 upper left column last line and p.35 lower right column line 12 to p.36 upper right column line 7 | p.63 line 51 to p.64 line 56 |
| Film Hardener | p.146 upper right column line 8 to p.155 lower left column line 4 | — | — |
| Developing Agent precursor | p.155 lower left column line 5 to p.155 lower right column line 2 | — | — |
| Compound releasing development inhibitor | p.155 lower right column lines 3 to 9 | — | — |
| Support | p.155 lower right column line 19 to p.156 upper left column line 14 | p.38 upper right column line 18 to p.39 upper left column line 3 | p.66 line 29 to p.67 line 13 |
| Constitution of photosensitive layer | p.156 upper left column line 15 to p.156 lower right column line 14 | p.28 upper right column lines 1 to 15 | p.45 lines 41 to 52 |
| Dye | p.156 lower right column line 15 to p.184 lower right column last line | p.38 upper left column line 12 to upper right column line 7 | p.66 lines 18 to 22 |
| Color-mix inhibitor | p.185 upper left column line 1 to p.188 lower right column line 3 | p.36 upper right column lines 8 to 11 | p.64 line 57 to p.65 line 1 |
| Gradation controller | p.188 lower right column lines 4 to 8 | — | — |

-continued

| Element constituting photographic material | JP-A No. 215272/1987 | JP-A No. 33144/1990 | EP 0,355,660A2 |
|---|---|---|---|
| Stain inhibitor | p.188 lower right column line 9 to p.193 lower right column line 10 | p.37 upper left column last line to lower right column line 13 | p.65 line 32 to p.66 line 17 |
| Surface-active agent | p.201 lower left column line 1 to p.210 upper right column last line | p.18 upper right column line 1 to p.24 lower right column last line and p.27 lower left column line 10 from the bottom to lower right column line 9 | — |
| Fluorine-containing agent (As Antistatic agent, coating aid, lubricant, adhesion inhibitor, or the like) | p.210 lower left column line 1 to p.222 lower left column line 5 | p.25 upper left column line 1 to p.27 lower right column line 9 | — |
| Binder (Hydrophilic colloid) | p.222 lower left column line 6 to p.225 upper left column last line | p.38 upper right column lines 8 to 18 | p.66 lines 23 to 28 |
| Thickening agent | p.225 upper right column line 1 to p.227 upper right column line 2 | — | — |
| Antistatic agent | p.227 upper right column line to p.230 upper left column line 1 | — | — |
| Polymer latex | p.230 upper left column line 2 to p.239 last line | — | — |
| Matting agent | p.240 upper left column line 1 to p.240 upper right column last line | — | — |
| Photographic processing method (processing process, additive, etc.) | p.3 upper right column line 7 to p.10 upper right column line 5 | p.39 upper left column line 4 to p.42 upper left column last line | p.67 line 14 to p.69 line 28 |

Note: In the cited part of JP-A No. 215272/1987, amendment filed on March 16, 1987 is included. Further, among the above-mentioned couplers, it is preferred to use so called short wavelength-type yellow coupler, described in JP-A Nos. 231451/1988, 123047/1988, 241547/1988, 173499/1989, 213648/1989, and 250944/1989, as a yellow coupler.

Preferably, the cyan, magenta, and yellow couplers are impregnated into loadable latex polymers (e.g., loadable latex polymers described in U.S. Pat. No. 4,203,716) in the presence or absence of a high-boiling organic solvent listed in the above table, or they are dissolved together with water-insoluble and organic solvent-soluble polymers and are emulsified and dispersed into hydrophilic colloid aqueous solution. As water-insoluble and organic solvent-soluble polymers that can be preferably used, homopolymers or copolymers described in U.S. Pat. No. 4,857,449, the seventh column to the fifteenth column, and in International Publication No. WO 88/00723, pages 12 to 30, can be mentioned. More preferably, methacrylate-type polymers or acrylamide-type polymers, particularly acrylamide-type polymers, are used in view of color image stability and the like.

In the photographic material according to the present invention, color image preservability improving compounds as described in European Patent No. 0277589A2 are preferably used together with couplers, particularly, together with pyrazoloazole couplers and pyrrolotriazole couplers.

That is, the use of a compound described in the above-mentioned patent specifications that combines with the aromatic amine developing agent remaining after the color development processing to form a chemically inactive and substantially colorless compound and/or a compound described in the above-mentioned patent specifications that combines with the oxidized product of the aromatic amine color developing agent remaining after the color development processing to form a chemically inactive and substantially colorless compound simultaneously or singly is preferable, because, for example, the occurrence of stain or other side effects due to the formation of color formed dyes by the reaction of the color developing agent or its oxidized product remaining in the film during the storage after the processing with couplers can be prevented.

Further, as the cyan couplers, in addition to diphenylimidazole cyan couplers described in JP-A No. 33144/1990, 3-hydroxypyridine cyan couplers described in European Patent No. 0333185A2 (particularly, that formed by attaching a chlorine coupling-off group to the 4-equivalent coupler of Coupler (42) to make it to be 2-equivalent and Couplers (6) and (9) which are listed as specific examples are preferable), cyclic active methylene cyan couplers described in JP-A No. 32260/1989 (particularly Coupler Examples 3, 8, and 34 that are listed as specific examples are preferable), pyrrolopyrazole cyan couplers described in European Patent No. 0456226A1, pyrroloimidazole cyan couplers described in European Patent No. 0484909, and pyrrolotirazole cyan couplers described in European Patents Nos. 0488248 and 491197A1 are preferably used. Among them, pyrrolotriazole cyan couplers are particularly preferably used.

As the yellow couplers, in addition to the compounds listed in the above table, acylacetamide yellow couplers whose acyl group has a 3- to 5-membered cyclic structure described in European Patent No. 0447969A1, malondianilide yellow coupler having a cyclic structure described in European Patent No. 0482552A1, and acylacetamide yellow couplers having a dioxane structure described in U.S. Pat. No. 5,118,599 are preferably used. Among them, acylacetamide yellow couplers whose acyl group is a 1-alkylcyclopropane-1-carbonyl group and malondianilide yellow couplers wherein one of the anilide constitutes an indoline ring are preferably used. These couplers can be used alone or in combination.

As the magenta couplers used in the present invention, 5-pyrazolone magenta couplers and pyrazoloazole magenta couplers as described in the known literature shown in the above table are used, but in particular, in view, for example, of the hue, the stability of images, and the color forming properties, pyrazolotriazole couplers wherein a secondary or tertiary alkyl group is bonded directly to the 2-, 3-, or 6-position of the pyrazolotriazole ring as described in JP-A No. 65245/1986, pyrazoloazole couplers containing a sulfonamido group in the molecule as described in JP-A No. 65246/1986, pyrazoloazole couplers having an alkoxyphenylsulfonamido ballasting group as described in JP-A No. 147254/1986, and pyrazoloazole couplers having an alkoxy group or an aryloxy group in the 6-position as described in European Patent Nos. 0226849A and 0294785A are preferably used.

As the method for processing the color photographic material of the present invention, in addition to the methods listed in the above table, processing materials and processing methods described in JP-A No. 207250/1990, page 26 (the right lower column, line 1) to page 34 (the right upper column, line 9) and JP-A No. 97355/1992, page 5 (the left upper column, line 17) to page 18 (the right lower column, line 20) are preferable.

According to the present invention, a hard copy having a high-image-quality can be provided inexpensively and rapidly. Further, according to the present invention, the fluctuation of photographic properties due to changes of development processing conditions can be prevented, and, in particular, such an excellent effect as showing stable photographic properties against change in developer, even with the photographic material after storage can be obtained.

Now the present invention will be described in more detail according to Examples, but the invention is not limited to them.

EXAMPLE 1

(Preparation of Photographic Material)

A multilayer color print paper (101) having layer compositions shown below was prepared by coating various photographic constituting layers on a paper support laminated on both sides thereof with polyethylene film containing 15 wt % of white pigment, followed by subjecting to a corona discharge treatment on the surface thereof and provided a gelatin prime coat layer containing sodium dodecylbenzenesulfonate. Coating solutions were prepared as follows (the centerline surface roughness of support before coating said photographic constituting layers was 0.12 μm):

Preparation of the First Layer Coating Solution 153.0 Grams of yellow coupler (ExY), 15.0 g of image-dye stabilizer (Cpd-1), 7.5 g of image-dye stabilizer (Cpd-2), 16.0 g of image-dye stabilizer (Cpd-3) were dissolved in 25 g of solvent (Solv-1), 25 g of solvent (Solv-2), and 180 ml of ethyl acetate, and the resulting solution was dispersed and emulsified in 1,000 ml of 10% aqueous gelatin solution containing 60 ml of 10% sodium dodecylbenzenesulfonate solution and 10 g of citric acid, thereby prepared emulsified dispersion A. Separately silver chlorobromide emulsion A (cubic grains, 3:7 (silver mol ratio) blend of large size emulsion having 0.88 μm of average grain size and small size emulsion having 0.70 μm of average grain size, and 0.08 and 0.10 of deviation coefficient of grain size distribution, respectively, each of the emulsions has 0.3 mol % of silver bromide being localized at a part of grain surface; the remaining parts of grain was made of silver chloride; and at the inner side of grains and in the silver bromide-localized layer 0.5 mg of potassium hexachloroiridate (IV) and 2.5 mg of potassium ferrocyanide, each in total amount, were contained) was prepared. Blue-sensitive sensitizing dyes A and B, shown below, were added in amounts of dyes that corresponds to $2.0\times10^{-4}$ mol and $2.5\times10^{-4}$ mol to the large size emulsion and small size emulsion, per mol of silver, respectively. The chemical ripening of this emulsion was carried out optimumly by adding sulfur sensitizing agent ($1.0\times10^{-5}$ mol/mol Ag of sodium thiosulfate) and gold sensitizing agent ($1.0\times10^{-5}$ mol/mol of chloroauric acid) in the presence decomposed product of nucleic acid. The above-described emulsified dispersion A and this silver chlorobromide emulsion A were mixed together and dissolved to give the composition shown below, thereby preparing the first layer coating solution.

Coating solutions for the second to seventh layers were also prepared in the same manner as the first layer coating solution. As a gelatin hardener for the respective layers, 1-oxy-3,5-dichloro-s-triazine sodium salt was used.

Further, Cpd-14 and Cpd-15 were added in each layer in such amounts that the respective total amount becomes 25.0 mg/m$^2$ and 50.0 mg/m$^2$.

Silver chlorobromide emulsion in each photosensitive emulsion layer was controlled in size of grains in the same manner as the above described silver chlorobromide emulsion A, and spectral sensitizing dyes shown below were used in respective layers. Blue-sensitive emulsion layer:

Sensitizing dye A

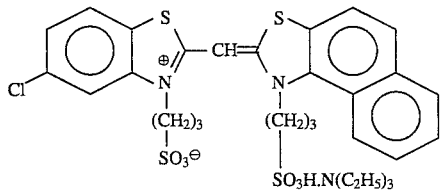

and

Sensitizing dye B

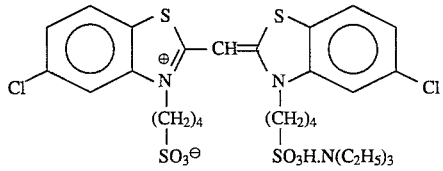

(each $2.0\times10^{-4}$ mol to the large size emulsion and $2.5\times10^{-4}$ mol to the small size emulsion, per mol of silver halide.)

Green-sensitive emulsion layer:

Sensitizing dye C

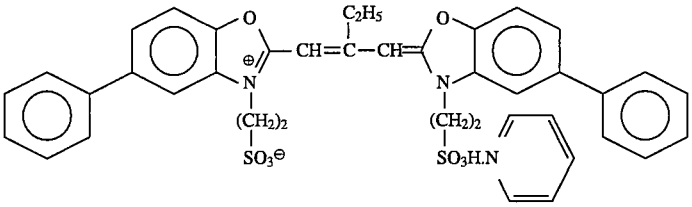

($4.0\times10^{-4}$ mol to the large size emulsion and $5.6\times10^{-4}$ mol to the small size emulsion, per mol of silver halide) and Sensitizing dye D

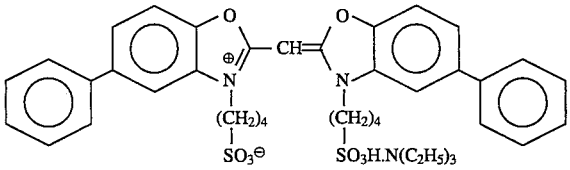

($7.0\times10^{-5}$ mol to the large size emulsion and $1.0\times10^{-5}$ mol to the small size emulsion, per mol of silver halide)

Red-sensitive emulsion layer:

Sensitizing dye E

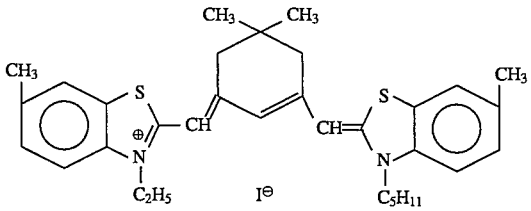

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

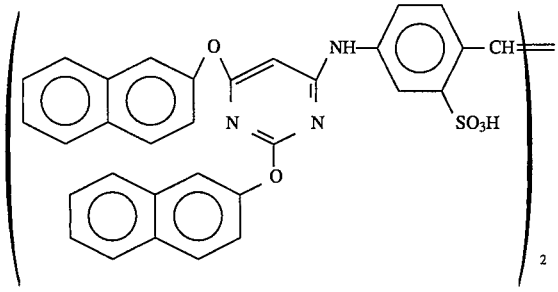

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

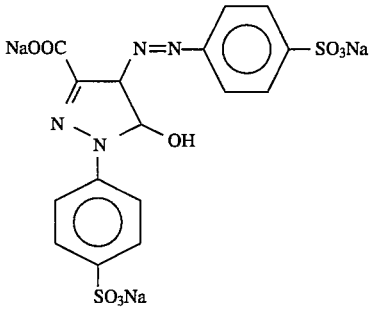

(10 mg/m²)

-continued

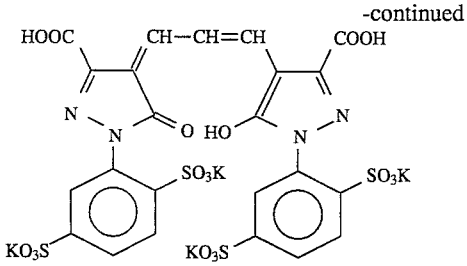

(10 mg/m²)

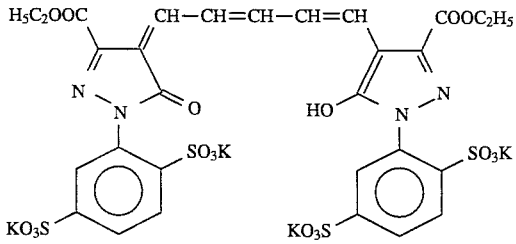

(40 mg/m²)

and

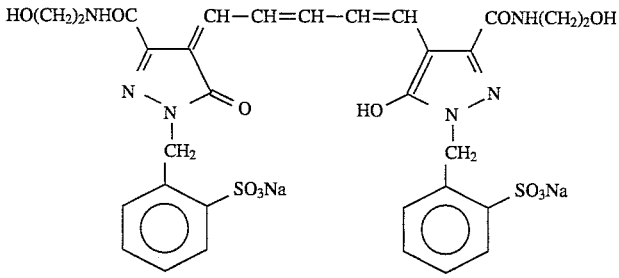

(20 mg/m²)

(Composition of Layers)

The composition of each layer is shown below. The figures represent coating amount (g/m²). The coating amount of each silver halide emulsion is given in terms of silver.

Supporting Base

Paper laminated on both sides with polyethylene, a white pigment ($TiO_2$: content of 15 wt %) and a bluish dye (ultra-marine, were included in the first layer side of the polyethylene-laminated film)

| | |
|---|---|
| First Layer (Blue-sensitive emulsion layer) | |
| The above described silver chlorobromide emulsion A | 0.27 |
| Gelatin | 1.22 |
| Yellow coupler (ExY) | 0.79 |
| Image-dye stabilizer (Cpd-1) | 0.08 |
| Image-dye stabilizer (Cpd-2) | 0.04 |
| Image dye stabilizer (Cpd-3) | 0.08 |
| Solvent (Solv-1) | 0.13 |
| Solvent (Solv-2) | 0.13 |
| Second Layer (Color-mix preventing layer) | |
| Gelatin | 0.90 |
| Color mix inhibitor (Cpd-4) | 0.06 |
| Solvent (Solv-7) | 0.03 |
| Solvent (Solv-2) | 0.25 |
| Solvent (Solv-3) | 0.25 |
| Third Layer (Green-sensitive emulsion layer) | |
| Silver chlorobromide emulsion B (cubic grains, 1:3 (Ag mol ratio) blend of large size emulsion having average grain size of 0.55 μm and small size emulsion having average grain size of 0.39 μm, whose deviation coefficient of grain size distribution is 0.10 and 0.08, respectively; each of the emulsions has 0.8 mol % of silver bromide being localized at a part of grain surface, the remaining part of grain is made of silver chloride; and at the inner side of grains and in the silver bromide-localized layer 0.5 mg of potassium hexachloroiridate (IV) and 2 mg of potassium ferrocyanide, each in total amount, were contained) | 0.13 |

-continued

| | |
|---|---|
| Gelatin | 1.28 |
| Magenta coupler (Exm) | 0.16 |
| Image-dye stabilizer (Cpd-5) | 0.15 |
| Image-dye stabilizer (Cpd-2) | 0.03 |
| Image-dye stabilizer (Cpd-6) | 0.01 |
| Image-dye stabilizer (Cpd-7) | 0.01 |
| Image-dye stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 0.70 |
| Color-mix inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (Red-sensitive emulsion layer) | |
| Silver chlorobromide emulsion C (cubic grains, 1:4 (Ag mol ratio) blend of large size emulsion having average grain size of 0.50 μm and small size emulsion C | 0.18 |

-continued

| | |
|---|---|
| having average grain size of 0.41 μm, whose deviation coefficient of grain size distribution is 0.09 and 0.11, respectively; each of the emulsions has 0.8 mol % of silver bromide being localized at a part of grain surface; the remaining part of grain is made of silver chloride; and at the inner side of grains and in the silver bromide-localized layer 0.5 mg of potassium hexachloroiridate (IV) and 2.5 mg of potassium ferrocyanide, each in total amount, were contained) | |
| Gelatin | 0.80 |
| Cyan coupler (ExC) | 0.33 |
| Ultraviolet absorber (UV-2) | 0.18 |
| Image-dye stabilizer (Cpd-1) | 0.33 |
| Image-dye stabilizer (Cpd-6) | 0.01 |
| Image-dye stabilizer (Cpd-8) | 0.01 |
| Image-dye stabilizer (Cpd-9) | 0.01 |
| Image-dye stabilizer (Cpd-10) | 0.01 |
| Image-dye stabilizer (Cpd-11) | 0.01 |
| Solvent (Solv-1) | 0.01 |
| Solvent (Solv-6) | 0.22 |
| Sixth Layer (Ultraviolet absorbing layer) | |
| Gelatin | 0.48 |
| Ultraviolet absorber (UV-1) | 0.38 |
| Image-dye stabilizer (Cpd-5) | 0.02 |
| Image-dye stabilizer (Cpd-12) | 0.15 |
| Seventh Layer (Protective layer) | |
| Gelatin | 1.10 |
| Acryl-modified copolymer of polyvinyl alcohol (modification degree: 17%) | 0.05 |
| Liquid paraffin | 0.02 |
| Image-dye stabilizer (Cpd-13) | 0.01 |

Compounds used are as follows: (ExY) Yellow coupler Mixture ((1):(2)=1:1 in molar ratio) of (1) R = 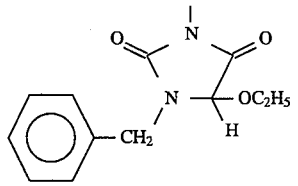 , X = Cl;

(2) R = 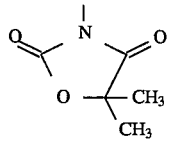 , X = Cl; X = $OCH_3$ of the following formula

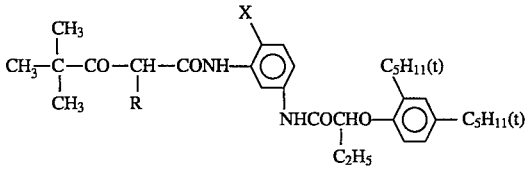

(ExM) Magenta coupler

-continued

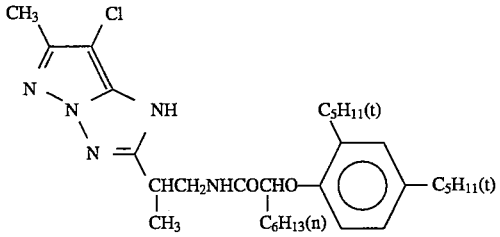

(ExC) Cyan coupler
Mixture (3:7 in molar ratio)

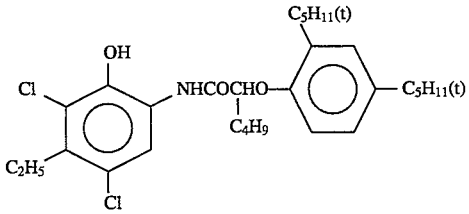

and

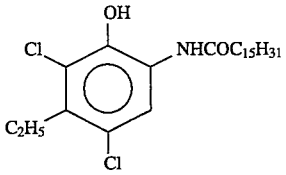

(Cpd-1) Image-dye stabilizer $\left(CH_2-\underset{\underset{CONHC_4H_9(t)}{|}}{CH}\right)_n$ Av. molecular weight: 60,000

(Cpd-2) Image-dye stabilizer

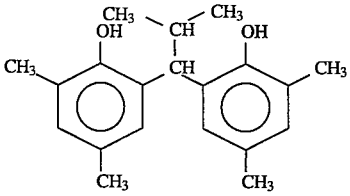

(Cpd-3) Image-dye stabilizer

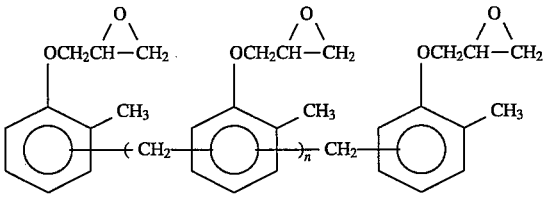

n = 7–8 (in average)

(Cpd-4) Color-mix inhibitor

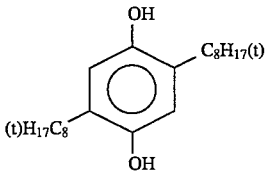

(Cpd-5) Image-dye stabilizer

-continued

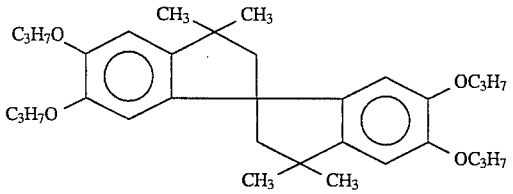

(Cpd-6) Image-dye stabilizer

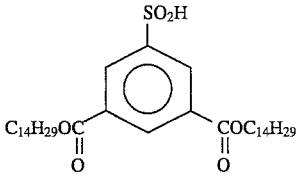

(Cpd-7) Image-dye stabilizer

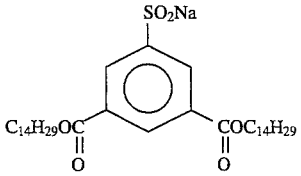

(Cpd-8) Image-dye stabilizer

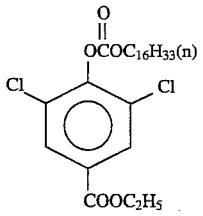

(Cpd-9) Image-dye stabilizer

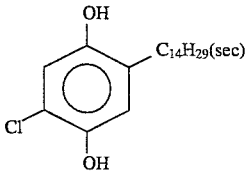

(Cpd-10) Image-dye stabilizer

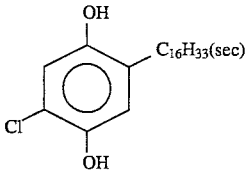

(Cpd-11) Image-dye stabilizer

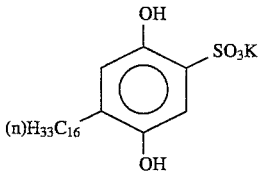

(Cpd-12) Image-dye stabilizer

-continued

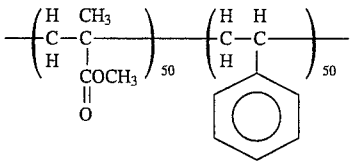

Av. molecular weight: 60,000

(Cpd-13) Image-dye stabilizer

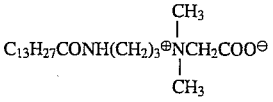

(Cpd-14) Antiseptic

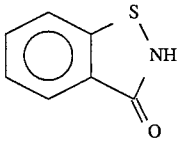

(Cpd-15) Antiseptic

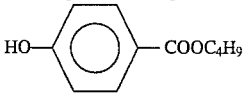

(UV-1) Ultraviolet ray absorber
Mixture of (i), (ii), (iii), and (iv)
(10:5:1:5 in weight ratio)

(i)

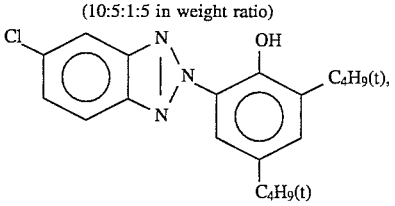

(ii)

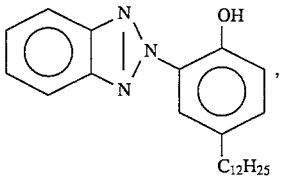

and (iii)

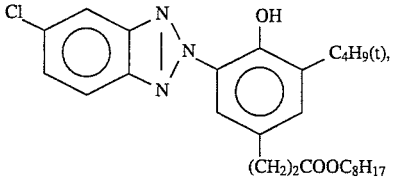

(iv)

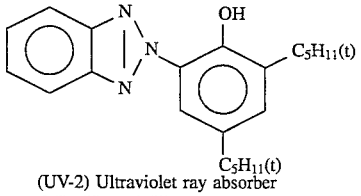

(UV-2) Ultraviolet ray absorber
Mixture of (i), (ii), and (iii) (1:2:2 in weight ratio)

-continued (i)

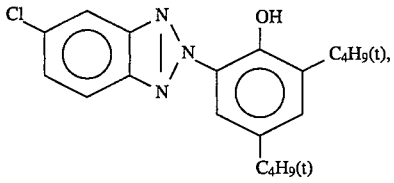

(ii)

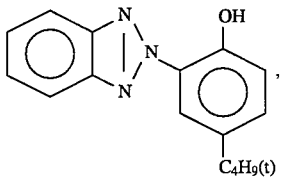

and (iii)

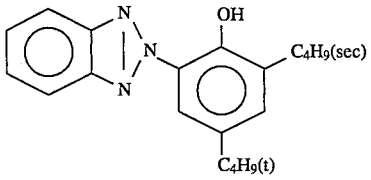

(Solv-1) Solvent

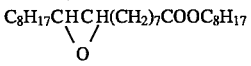

(Solv-2) Solvent

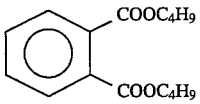

(Solv-3) Solvent

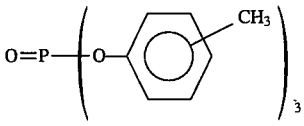

(Solv-4) Solvent

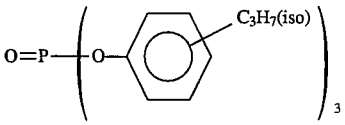

(Solv-5) Solvent

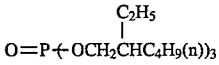

(Solv-6) Solvent

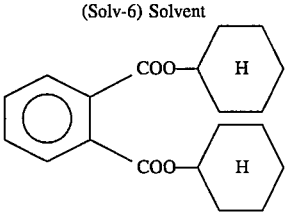

(Solv-7) Solvent

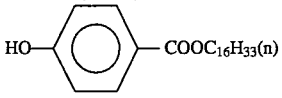

Photographic materials 102 to 111 having the similar composition to photographic material 101 were prepared, except that compound (Cpd-4) in the second and seventh layer (color-mix preventing layer) was changed to compound shown in the following Table 2.

TABLE 2

| Photo-graphic Material No. | Compound used in the 2nd and the 4th layer: Compound | Molecular Weight | Amount used (2nd/4th) ($g/m^2$)* | Remarks |
|---|---|---|---|---|
| 101 | Cpd-4 | 334.6 | 0.06/0.04 | Example |
| 102 | HQ-1 | 338.4 | 0.06/0.04 | " |
| 103 | SV-1 | 530.9 | 0.10/0.06 | This Invention |
| 104 | SV-4 | 559.0 | 0.10/0.07 | " |
| 105 | Sv-5 | 446.8 | 0.08/0.05 | " |
| 106 | SV-8 | 443.6 | 0.08/0.05 | " |
| 107 | Sv-9 | 773.1 | 0.14/0.09 | " |
| 108 | SV-16 | 502.8 | 0.09/0.06 | " |
| 109 | SV-17 | 502.8 | 0.09/0.06 | " |
| 110 | SV-20 | 390.7 | 0.07/0.05 | " |
| 111 | SV-23 | 404.7 | 0.07/0.05 | " |

Note; *Equimolar amount to (Cpd-4) in photographic material No. 101 was used.

HQ-1

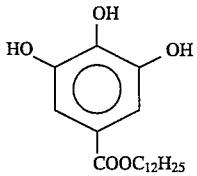

The prepared photographic materials were stored in two ways:

I: stored in a refrigerator (8° C.) for 2 days.

II: stored at 50° C. and 80% R.H. for 2 days (these forced conditions were to simulate long-term storage conditions for the photographic material).

After the storage, the samples were exposed to light in the two ways shown below.

(I) Scanning Exposure 473 nm, isolated by converting the wavelength of a YAG solid laser (emission wavelength: 946 nm) using an SHG crystal of $KNbO_3$, the YAG solid laser having used an excited light source of a semiconductor laser GaAlAs (emission wavelength: 808.5 nm); 532 nm, isolated by converting the wavelength of a YVO4 solid laser (emission wavelength: 1064) using an SHG crystal of KTP, the YOV4 solid laser having used as an excited light source of a semiconductor laser GaAl As (emission wavelength: 808.7 nm); and a semiconductor laser AlGaInP (emission wavelength: about 670 nm; Type No. TOLD9211, manufactured by Toshiba); were used as light sources. The apparatus can carry out scanning exposure successively by moving respective laser beams by a rotating polyhedron onto color photographic printing paper moved vertically to the direction of the scanning of the laser beams. Using this apparatus, the amount of light was changed to find the relationship D—logE, wherein D represents the density of the photographic material and E represents the amount of light. With respect to the three laser beams, the amounts of the light were modulated using an external modulator to control the exposure amount. This scanning exposure was carried out at 400 dpi, and the average exposure time per picture element was about $5\times10^{-8}$ sec. The temperature of the semiconductors was kept constant using Peltier elements, to suppress the change of the amount of light due to the temperature.

(2) Surface Exposure

Using a sensitometer (manufactured by Fuji Photo Film Co., Ltd.; FWH type; color temperature of the light source: 3200K) and interference filters of 470 nm, 535 nm, and 670 nm to take up monochromatic lights, gradation exposure was given through a gradation wedge for sensitometry. At that time, the exposure to light was such that the exposure amount was 2500 CMS per 1 sec of exposure to light.

The exposed samples were color-developed using a paper processor in the following steps. At that time, the concentrations of the color-developing agent of the color developer were (a) 5.0 g/l and (b) 3.0 g/l.

The reciprocal number of the logarithm of the amount of light required to give 1.0 to the magenta density of the green-sensitive layer of the obtained Samples (a) and (b) was determined, to find sensitivities $S_M$[1-(a)] (the sensitivity of the sample obtained by subjecting to the exposure (1) and to the processing (a)), $S_M$[1-(b)], SM[2-(a)] (the sensitivity of the sample obtained by subjecting to the exposure (2) and the processing (a)), and $S_M$[2-(b)]. The differences of the sensitivities:

$$\Delta S1=S_M[1\text{-}(b)]-S_M[1\text{-}(a)], \text{ and}$$

$$\Delta S2=S_M[2\text{-}(b)]-S_M[2\text{-}(a)]$$

were obtained. Each of these differences is used as a scale of the change of the sensitivity of the green-sensitive layer caused by a change in the concentration of developing agent in the processing solution at the time when scanning exposure and plane exposure were carried out. With respect to two samples stored under above-mentioned conditions I and II, respective differences of the sensitivities, i.e., ΔSI-1 [the difference of sensitivities caused by the change of processing solution of sample stored under condition I and subjected to the exposure (1) (scanning exposure)], ΔSII-1 [the difference of sensitivities caused by the change of processing solution of sample stored under condition II and subjected to the exposure (1)], ΔSI-2, and ΔSII-2 were obtained and used as scales of differences of sensitivities between before and after storage, and between exposure conditions (1) and (2).

| Processing step | Temperature | Time |
|---|---|---|
| Color developing | 35° C. | 45 sec |
| Bleach-fixing | 30–35° C. | 45 sec |
| Rinse (1) | 30–35° C. | 20 sec |
| Rinse (2) | 30–35° C. | 20 sec |
| Rinse (3) | 30–35° C. | 20 sec |
| Drying | 70–80° C. | 60 sec |

The composition of each processing solution is as follows, respectively:

| | Tank Solution |
|---|---|
| Color-developer | |
| Water | 800 ml |
| Ethylenediamine-N,N,N',N'-tetramethylene phosphonic acid | 1.5 g |
| Potassium bromide | 0.015 g |
| Triethanolamine | 8.0 g |
| Sodium chloride | 1.4 g |
| Potassium carbonate | 25 g |
| N-ethyl-N-(β-methanesulfonamidoethyl)-3-methyl-4-aminoaniline·3/2 sulfate·monohydrate | (a) 5.0 g (b) 3.0 g |
| N,N-Bis(carboxymethyl)hydrazine | 4.0 g |
| Monosodium·N,N-di(sulfoethyl) hydroxylamine | 4.0 g |
| Fluorescent whitening agent (WHITEX 4B, made by Sumitomo Chemical Ind.) | 1.0 g |
| Water to make | 1000 ml |
| pH (25° C.) | 10.15 |
| Bleach-fixing solution | |
| Water | 400 ml |
| Ammonium thiosulfate (700 g/l) | 100 ml |
| Sodium sulfite | 17 g |
| Iron (III) ammonium ethylenediaminetetraacetate | 55 g |
| Disodium ethylenediaminetetraacetate | 5 g |
| Ammonium bromide | 40 g |
| Water to make | 1000 ml |
| pH (25° C.) | 6.0 |

Rinse Solution

Ion-exchanged water (calcium and magnesium each are 3 ppm or below)

Results obtained are shown in Table 3.

TABLE 3

| Photo-graphic Material | Change of Sensitivities of Magenta Layer due to Change of Amount of Developing Agent | | | | Remarks |
|---|---|---|---|---|---|
| | (1) Scanning Exposure | | (2) Surface Exposure | | |
| | ΔSI-1 | ΔSII-1 | ΔSI-2 | ΔSII-2 | |
| 101 | −0.04 | −0.08 | −0.02 | −0.03 | Comparative Example |
| 102 | −0.05 | −0.09 | −0.03 | −0.03 | " |
| 103 | −0.02 | −0.03 | −0.02 | −0.03 | This Invention |
| 104 | −0.02 | −0.03 | −0.02 | −0.02 | " |
| 105 | −0.03 | −0.04 | −0.02 | −0.03 | " |
| 106 | −0.03 | −0.03 | −0.02 | −0.03 | " |
| 107 | −0.02 | −0.03 | −0.03 | −0.03 | " |
| 108 | −0.02 | −0.03 | −0.02 | −0.03 | " |
| 109 | −0.03 | −0.04 | −0.03 | −0.03 | " |
| 110 | −0.03 | −0.03 | −0.02 | −0.03 | " |
| 111 | −0.02 | −0.03 | −0.03 | −0.03 | " |

Note; $\Delta SI\text{-}1 = S_M[1\text{-}(b)] - S_M[1\text{-}(a)]$
:Difference of sensitivities of processing (a) and (b) after exposure to light (1) (scanning exposure) to Sample storaged under condition I
ΔSII-1: Difference of sensitivities of processing (a) and (b) after exposure to light (1) to Sample storaged under condition II
ΔSI-2: Difference of sensitivities of processing (a) and (b) after exposure to light (2) to Sample storaged under condition I
ΔSII-2: Difference of sensitivities of processing (a) and (b) after exposure to light (2) to Sample storaged under condition II
Storage condition I: In refrigerator for 2 days
Storage condition II: At 50° C., 80% R.H. for 2 days From the obtained results, it can be understood that, when the compound having a molecular weight of 390 or more is used in a color-mix preventing layer, compared with the case using the compound having a molecular weight less than 390, the fluctuation of sensitivity of green-sensitive emulsion layer due to changes in processing solutions becomes small, and that this effect is specific in the case of scanning exposure to light that is a high illumination exposure in a short time.

EXAMPLE 2

(Preparation of Emulsion A)

3.3 Grams of sodium chloride and 24 ml of 1N sulfuric acid were added to a 3% aqueous lime-processed gelatin solution, and then 3.2 ml of N,N'-dimethylimidazolidine-2-thion (a 2% aqueous solution) was added. To this aqueous solution were added an aqueous solution containing 0.7 mol of silver nitrate and an aqueous solution containing 0.7 mol of sodium chloride and 15 μg of rhodium trichloride, at 58° C. with vigorous stirring. Then, an aqueous solution containing 0.29 mol of silver nitrate and an aqueous solution containing 0.29 mol of sodium chloride and 4.2 mg of potassium ferrocyanide were added thereto at 58° C. with violent stirring. After 5 min of the completion of the addition of the aqueous silver nitrate solution and the aqueous halogenated alkali solution, a copolymer of isobutene/monosodium maleate was added, to allow sedimentation to take place and washing with water was carried out, to effect desalting. Further, 90.0 g of lime-processed gelatin was added, and the pH and pAG of the emulsion were adjusted to 6.8 and 7.0, respectively, and $2\times10^{-4}$ mol of (Dye-F) was added, at 50° C. and then after 15 min, silver bromide fine grains (the grain size: 0.05 μm) in an amount of 0.01 mol in terms of silver nitrate, and an aqueous solution containing potassium hexachloroiridate(IV) in an amount of 0.8 mg, were added, with vigorous stirring. Further, $1\times10^{-5}$ mol of a sulfur sensitizer (triethyl thiourea)/mol of Ag, $1\times10^{-5}$ mol of chloroplatinic acid/mol of Ag, and 0.2 g of nucleic acids per mol of Ag were added, to optimally chemically sensitize the emulsion at 50° C.

With respect to the obtained silver bromochloride grains a, the shape of the grains, the grain size, and the grain size distribution were determined from an electron micrograph thereof. These silver halide grains were cubic; the grain size was 0.51 μm; and the deviation coefficient was 0.08. The grain size was represented by the average value of the diameters of the circles equivalent to the projected areas of the grains, and the deviation coefficient was represented by the value obtained by dividing the standard deviation by the average grain size.

Then, the X-ray diffraction from the silver halide crystals was measured, to determine the halogen composition of the emulsion grains. A monochromatized CuKα ray was used as a radiation source to measure the angle of diffraction from the (200) plane. While the diffraction line from a crystal uniform in halogen composition gives a single peak, the diffraction line from a crystal having localized phases different in composition gives peaks whose number corresponds to the number of the compositions. By calculating the lattice constant from the angle of diffraction of the measured peak, the halogen composition of the silver halide constituting the crystal can be determined. From the results of the measurement of the silver chlorobromide emulsion, a broad diffraction pattern having, as a center, besides the main peak of 100% silver chloride, 70% silver chloride (30% silver bromide) with a base spreading near to 60% silver chloride (40% silver bromide), was observed.

(Preparation of Emulsions B and C)

The procedure for the preparation of the emulsion a was repeated, except that, instead of (Dye-F), (Dye-G) in an amount of $4\times10^{-5}$ mol, and (Dye-H) in an amount of $2\times10^{-5}$ mol, were used, thereby preparing (Dye-F)
Mixture (1:1 in molar ratio) of
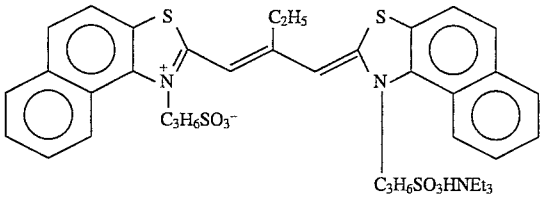
and
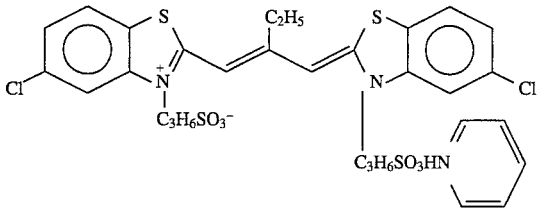
(Dye-G)
Mixture (1:1 in molar ratio) of
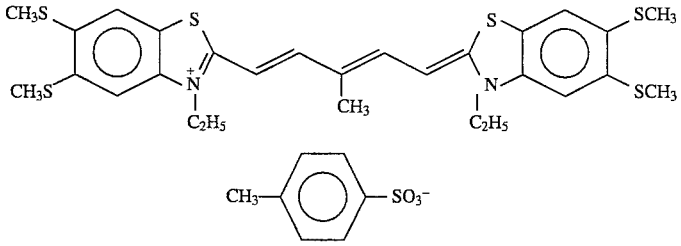
and
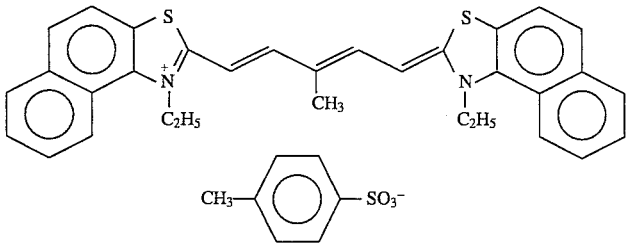
(Dye-H)
Mixture (1:1 in molar ratio) of
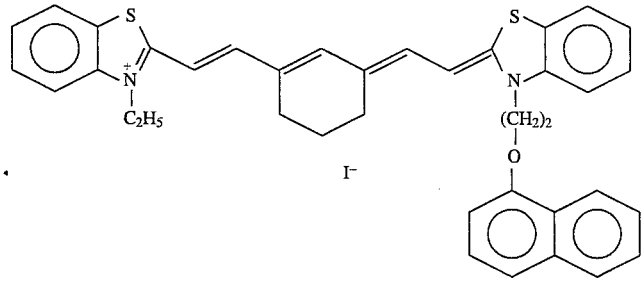
and -continued

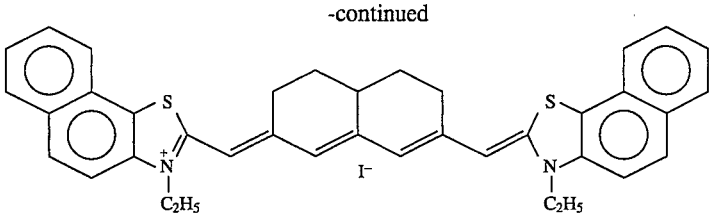

To the emulsions a, b, and c was added 1-( 5-methylureidophenyl)-5-mercaptotetrazole in an amount of $5.0\times10^{-4}$ mol, per mol of the silver chloride.

Further, to the emulsions b and c, (Cpd-16), (Cpd-17), and (Cpd-18) were added, respectively, in amounts $3\times10^{-3}$ mol, $1\times10^{-3}$ mol, and $1\times10^{-3}$ mol, respectively, per mol of silver halide.

(Cpd-16)

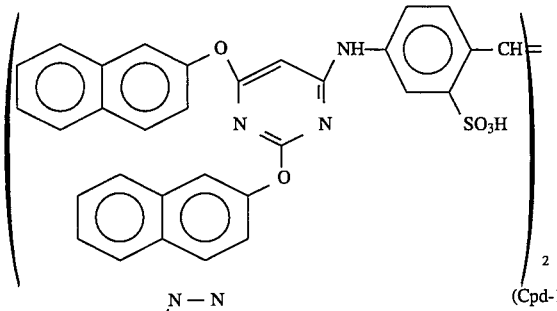

(Cpd-17)

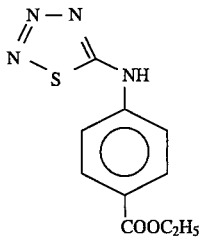

-continued

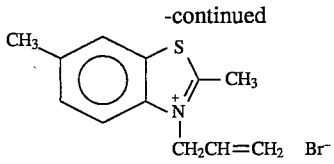

Cpd-18)

(Preparation of Photographic Material 201)

Photographic material 201 was prepared in the same manner as photographic material 101, except that, instead of the emulsions A, B, and C used in the first, third, and fifth layers of the photographic material 101, the emulsion a, the emulsion b, and the emulsion c were used in the first layer, the third layer, and the fifth layer, respectively, and, instead of the antiirradiation dye used in Example 1, the dye shown below was used.

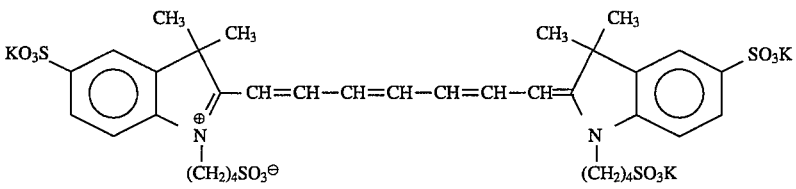

(3mg/m²)

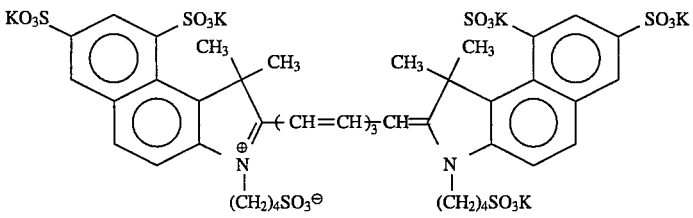

(5mg/m²)

-continued

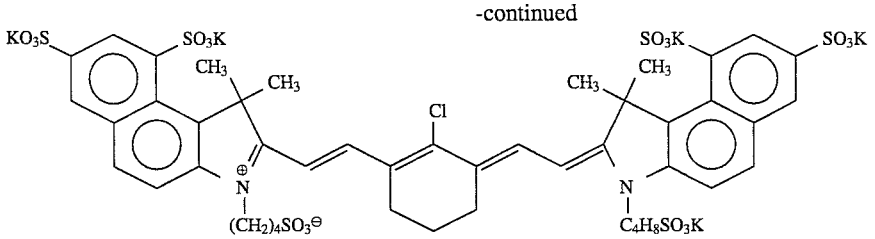

(5mg/m²)

and

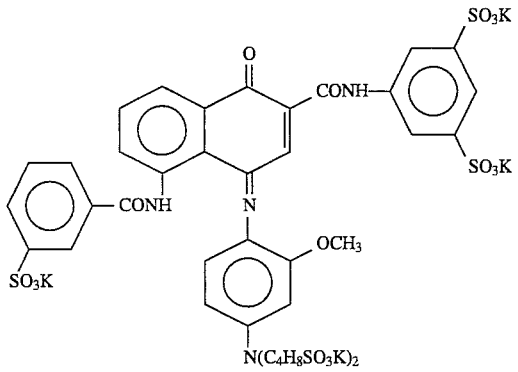

(25mg/m²)

This photographic material was made up of a red-sensitive yellow color-forming layer (first layer) having a spectral sensitivity maximum near 670 nm, a red-sensitive magenta color-forming layer (third layer) having a spectral sensitivity maximum near 730 nm, and an infrared-sensitive cyan color-forming layer (fifth layer) having a spectral sensitivity maximum near 830 nm.

Photographic materials 202 to 211 were prepared in the same manner as photographic material 201, except that the compound of the second and fourth layer were changed as shown in the following Table 4.

TABLE 4

| | Compound used in the 2nd and the 4th layer | | | |
|---|---|---|---|---|
| Photographic Material No. | Compound | Molecular Weight | Amount used (2nd/4th) (g/m²)* | Remarks |
| 201 | Cpd-4 | 334.6 | 0.06/0.04 | Comparative Example |
| 202 | HQ-1 | 338.4 | 0.06/0.04 | Comparative Example |
| 203 | SV-1 | 530.9 | 0.10/0.06 | This Invention |
| 204 | SV-4 | 559.0 | 0.10/0.07 | " |
| 205 | Sv-5 | 446.8 | 0.08/0.05 | " |
| 206 | SV-8 | 443.6 | 0.08/0.05 | " |
| 207 | Sv-9 | 773.1 | 0.14/0.09 | " |
| 208 | SV-16 | 502.8 | 0.09/0.06 | " |
| 209 | SV-17 | 502.8 | 0.09/0.06 | " |
| 210 | SV-20 | 390.7 | 0.07/0.05 | " |
| 211 | SV-23 | 404.7 | 0.07/0.05 | " |

Note; *Equimolar amount to (Cpd-4) in photographic material No. 201 was used.

The thus prepared photographic materials were exposed to light in the following two ways:

(1) Scanning Exposure

A semiconductor laser AlGaInP (the emitting wavelength: about 670 nm; Type No. TOLD9211, manufactured by Toshiba), a semiconductor laser GaAlAs (the emitting wavelength: about 750 nm; Type No. LTO30MDO, manufactured by Sharp Corporation), and a semiconductor laser GaAlAs (the emitting wavelength: about 830 nm; Type No. LTO15MDO manufactured by Sharp Corporation) were used. The apparatus was constituted such that by a rotating polygon the laser lights could traverse color paper moving in the direction orthogonal to the scanning direction, to carry out successively the exposure of the color paper to the lights. By using this apparatus, the amounts of lights were changed and the relationship D-log E between the density (D) of the photographic material and the amount of the light (E) was determined. The amount of light of the semiconductor laser for exposure was controlled by a combination of a pulse width modulating system, for modulating the amount of light by changing the time of electricity supply to the semiconductor laser, with an intensity modulating system, for modulating the amount of light by changing the amount of electricity supply. The scanning exposure was carried out with the picture element density being 400 dpi, and at that time the average exposure time per picture element was about $10^{-7}$ sec. The temperature of the semiconductor lasers was kept constant by using Peltier devices, so that the amounts of lights might be kept from changing by the temperature.

(2) Plane Exposure

Using a sensitometer (FWH type, manufactured by Fuji Photo Film Co., Ltd.; the color temperature of the light source: 3200K) and interference filters of 670 nm, 750 nm, and 830 nm, monochromatic lights were taken out and gradation exposure was given to the photographic material through a gradation wedge for sensitometry. At that time, the exposure to light was carried out such that the amount of exposure per sec of the exposure time was 25,000 CMS.

One of the samples exposed to light was processed in the steps shown in Example 1 with a freshly prepared color developer that was the same as shown in Example 1, to prepare Sample (a), and the other was processed in the same steps as above with the color developer that had been used continuously (running) until the replenishing amount reached twice the volume of the tank, to prepare Sample (b).

The obtained results of the samples are shown in Table 5.

TABLE 5

| Photographic Material | Change of Sensitivities of Magenta Layer due to Change of Amount of Developing Agent | | | | Remarks |
|---|---|---|---|---|---|
| | (1) Scanning Exposure | | (2) Surface Exposure | | |
| | ΔSI-1 | ΔSII-1 | ΔSI-2 | ΔSII-2 | |
| 201 | −0.05 | −0.10 | −0.03 | −0.04 | Comparative Example |
| 202 | −0.06 | −0.11 | −0.04 | −0.05 | " |
| 203 | −0.03 | −0.04 | −0.03 | −0.03 | This Invention |
| 204 | −0.03 | −0.04 | −0.03 | −0.04 | " |
| 205 | −0.04 | −0.04 | −0.03 | −0.04 | " |
| 206 | −0.03 | −0.04 | −0.03 | −0.04 | " |
| 207 | −0.03 | −0.04 | −0.02 | −0.03 | " |
| 208 | −0.04 | −0.05 | −0.03 | −0.04 | " |
| 209 | −0.03 | −0.04 | −0.03 | −0.03 | " |
| 210 | −0.03 | −0.04 | −0.03 | −0.04 | " |
| 211 | −0.03 | −0.04 | −0.03 | −0.03 | " |

Note; $\Delta SI\text{-}1 = S_M[1\text{-}(b)] - S_M[1\text{-}(a)]$
:Difference of sensitivities of processing (a) and (b) after exposure to light (1) (scanning exposure) to Sample storaged under condition I
ΔSII-1: Difference of sensitivities of processing (a) and (b) after exposure to light (1) to Sample storaged under condition II
ΔSI-2: Difference of sensitivities of processing (a) and (b) after exposure to light (2) to Sample storaged under condition I
ΔSII-2: Difference of sensitivities of processing (a) and (b) after exposure to light (2) to Sample storaged under condition II
Storage condition I: In refrigerator for 2 days
Storage condition II: At 50° C., 80% R.H. for 2 days From the obtained results, it can be understood that, when the compound having a molecular weight of 390 or more is used in a color-mix preventing layer, compared with the case using the compound having a molecular weight of less than 390, the fluctuation of sensitivity of infrared-sensitive layer due to changes in a processing solutions becomes small, and this effect is specific in the case of scanning exposure to light that is a high-illumination exposure in a short time of period. Further, this effect is more remarkable in infrared-sensitive emulsion layer compared with the case using in the green-sensitive layer in Example 1.

EXAMPLE 3

A photographic material 301 having layer compositions shown below was prepared.

(Preparation of Photographic Material 301)

A multilayer color print paper having layer compositions shown below was prepared by coating various photographic constituting layers on a paper support laminated on both sides thereof with polyethylene film, followed by subjecting to a corona discharge treatment on the surface thereof and provided a gelatin prime coat layer containing sodium dodecylbenzene-sulfonate. Coating solutions were prepared as follows:

Preparation of the First Layer Coating Solution

To 19.1 g of yellow coupler (Ex3Y), 4.4 g of image-dye stabilizer (Cpd-16), and 0.7 g of image-dye stabilizer (Cpd-1), 27.2 ml of ethyl acetate and each 4.1 g of solvent (Solv-9) and (Solv-1) were added and dissolved, and the resulting solution was dispersed and emulsified in 185 ml of 10% aqueous gelatin solution containing 8 ml of 10% sodium dodecylbenzenesulfonate solution, thereby prepared emulsified dispersion. Separately silver chlorobromide emulsion A was prepared in the same manner as in Example 1. The above-described emulsified dispersion and this silver chlorobromide emulsion A were mixed together and dissolved to give the composition shown below, thereby preparing the first layer coating solution.

Coating solutions for the second to seventh layer were prepared in the same manner as the coating solution for the first layer. As a gelatin hardener for the respective layers, 1-oxy-3,5-dichloro-s-triazine sodium salt was used.

Further, Cpd-14 and Cpd-15, the same as in Example 1, were added in each layer in such amounts that the respective total amount becomes 25.0 mg/m$^2$ and 50.0 mg/m$^2$.

As spectral sensitizing dyes for each emulsion layer (Dye-A/B), (Dye-C/D), and (Dye-E) which were used in Example 1 were used.

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes used in Example 1 for prevention of irradiation were added.

(Composition of Layers)

The composition of each layer is shown below. The figures represent coating amount (g/m2). The coating amount of each silver halide emulsion is given in terms of silver.

Supporting Base

Paper laminated on both sides with polyethylene (a white pigment, $TiO_2$ in content of 14 wt %, and a bluish dye, ultra-marine, were included in the first layer side of the polyethylene-laminated film)

| | |
|---|---|
| First Layer (Blue-sensitive emulsion layer) | |
| Silver chlorobromide emulsion A same as in Example 1 | 0.30 |
| Gelatin | 1.22 |
| Yellow coupler (Ex3Y) | 0.82 |
| Image-dye stabilizer (Cpd-16) | 0.19 |
| Solvent (Solv-9) | 0.18 |
| Solvent (Solv-1) | 0.18 |
| Image-dye stabilizer (Cpd-1) | 0.06 |
| Second Layer (Color-mix preventing layer) | |
| Gelatin | 0.64 |
| Color mix inhibitor (Cpd-4) | 0.10 |
| Solvent (Solv-2) | 0.16 |
| Solvent (Solv-3) | 0.08 |
| Third Layer (Green-sensitive emulsion layer) | |
| Silver chlorobromide emulsion B same as in Example 1 | 0.12 |
| Gelatin | 1.28 |
| Magenta coupler (Ex3M) | 0.23 |
| Image-dye stabilizer (Cpd-8) | 0.03 |
| Image-dye stabilizer (Cpd-5) | 0.16 |
| Image-dye stabilizer (Cpd-17) | 0.02 |
| Image-dye stabilizer (Cpd-2) | 0.02 |
| Solvent (Solv-32) | 0.40 |
| Fourth Layer (Ultraviolet ray-absorbing layer) | |
| Gelatin | 1.41 |
| Ultraviolet ray absorber (UV-3) | 0.47 |
| Color-mix inhibitor (Cpd-4) | 0.05 |
| Solvent (Solv-10) | 0.24 |
| Fifth Layer (Red-sensitive emulsion layer) | |
| Silver chlorobromide emulsion C same as Example 1 | 0.23 |
| Gelatin | 1.04 |
| Cyan coupler (Ex3C) | 0.32 |
| Image-dye stabilizer (Cpd-8) | 0.03 |
| Image-dye stabilizer (Cpd-3) | 0.02 |
| Image-dye stabilizer (Cpd-18) | 0.18 |
| Image-dye stabilizer (Cpd-1) | 0.40 |
| Image-dye stabilizer (Cpd-19) | 0.05 |
| Solvent (Solv-11) | 0.14 |
| Sixth Layer (Ultraviolet ray-absorbing layer) | |
| Gelatin | 0.48 |
| Ultraviolet ray absorber (UV-3) | 0.16 |
| Image-dye stabilizer (Cpd-4) | 0.02 |
| Solvent (Solv-10) | 0.08 |
| Seventh Layer (Protective layer) | |
| Gelatin | 1.10 |
| Acryl-modified copolymer of polyvinyl alcohol (modification degree: 17%) | 0.17 |
| Liquid paraffin | 0.03 |

Compounds used are as follows:

(Ex3Y) Yellow coupler

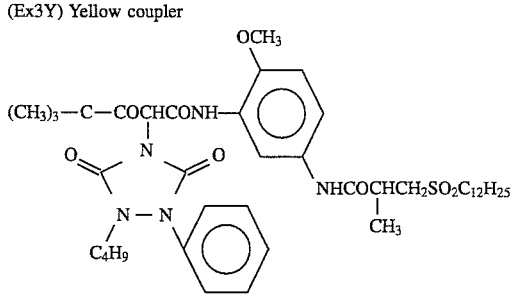

(Ex3M) Magenta coupler

-continued
Mixture (1:1 in weight ratio)
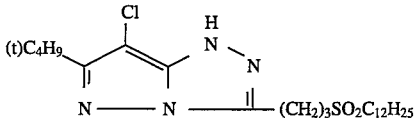
and
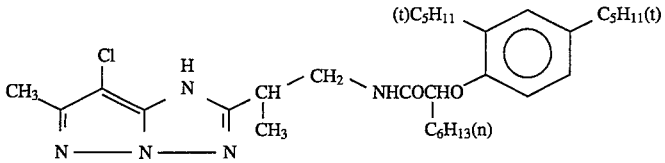
(Ex3C) Cyan coupler
Mixture (7:2 in molar ratio)
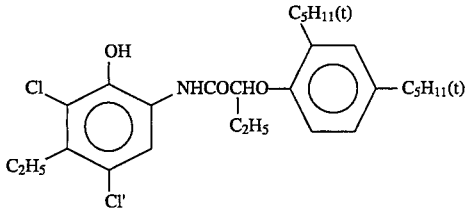
and
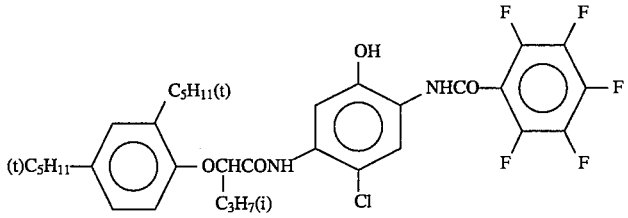
(Cpd-16) Image-dye stabilizer
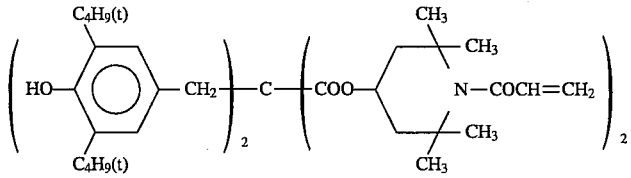
(Cpd-17) Image-dye stabilizer
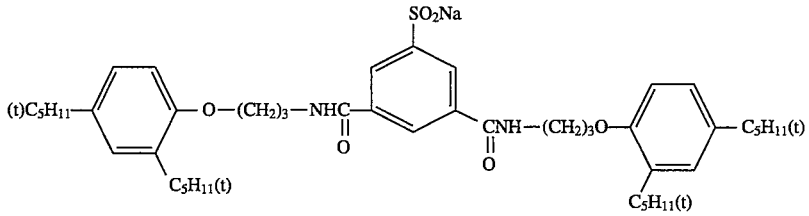
(Cpd-18) Image-dye stabilizer
Mixture (2:4:4 in weight ratio) of
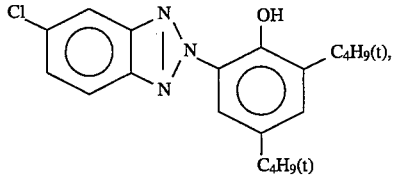
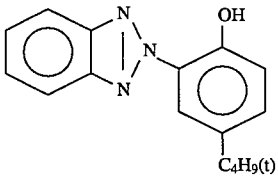
and -continued

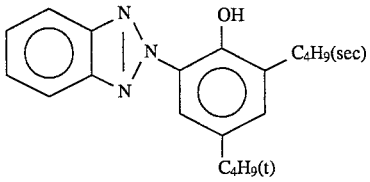

(Cpd-19) Image-dye stabilizer
Mixture (1:1 in weight ratio) of

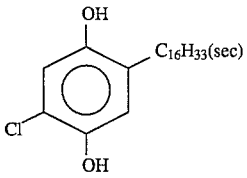

and

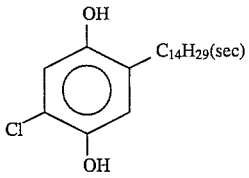

(UV-31) Ultraviolet ray absorber
Mixture (4:2:4 in weight ratio)

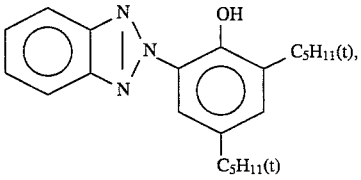

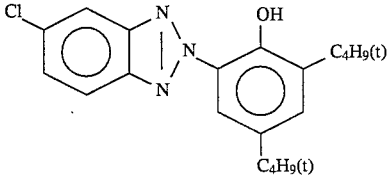

and

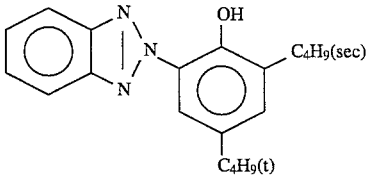

(Solv-8) Solvent
Mixture (1:1 in volume ratio)

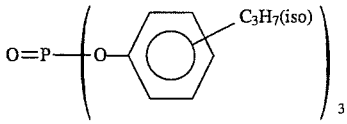

and

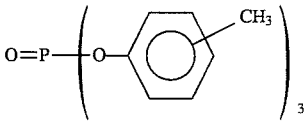

(Solv-9) Solvent
$O{=}P{+}O{-}C_9H_{19}(iso)]_3$ (Solv-10) Solvent $$\begin{array}{l} COOC_8H_{17} \\ | \\ (CH_2)_8 \\ | \\ COOC_8H_{17} \end{array}$$

(Solv-11) Solvent
Mixture (80:20 in weight ratio) of

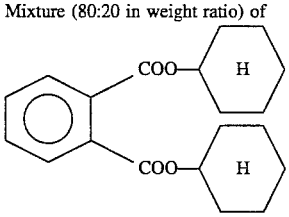

and $C_8H_{17}CH\underset{\underset{O}{\diagdown\ \diagup}}{CH}(CH_2)_7COOC_8H_{17}$ Photographic Materials 302 to 311 were prepared in the same manner as photographic material 301, except that compound (Cpd-4) used in the 2nd, the 4th, and the 6th layer was changed to the same compounds as used in the photographic material 102 to 111 in Example 1 (see Table 1).

Thus obtained photographic materials were subjected to the same exposure to light and developing process as in Example 1, and the similar evaluation was conducted. As a result, by the constitution according to the present invention, photographic materials small in fluctuation of photographic properties due to changes in processing solutions after the scanning exposure to light were obtained regardless of storage or no storage, as same as in Example 1.

EXAMPLE 4

Each of photographic materials prepared in Examples 1 to 3, that is, photographic materials 101 to 111, 201 to 211, and 301 to 311, was exposed to light in the same manner as in respective Examples, and then was processed, by a paper processor, in the steps shown below with a color developer immediately after preparation.

In this case, the developing was carried out with respect to the amount of developing agent being (a) 14.5 g/l and 8.00 g/l.

Developing process was conducted by using two kinds of developers containing (a) 14.5 g/l or (b) 8.00 g/l of developing agent. With respect to thus-obtained Samples (a) and (b), the same evaluation as Example 1 was conducted. From the results obtained, it was confirmed that the change in sensitivity due to change of processing solution became small by using constitution of the present invention, regardless of states of storages of photographic material, as similar to those of Examples 1 to 3.

| Processing process | Temperature | Time | Tank Volume |
|---|---|---|---|
| Color developing | 40° C. | 15 sec | 2 liter |
| Bleach-fixing | 40° C. | 15 sec | 2 liter |
| Rinse (1) | 40° C. | 3 sec | 1 liter |
| Rinse (2) | 40° C. | 3 sec | 1 liter |
| Rinse (3) | 40° C. | 3 sec | 1 liter |
| Rinse (4) | 40° C. | 3 sec | 1 liter |
| Rinse (5) | 40° C. | 6 sec | 1 liter |
| Drying | 70–80° C. | 15 sec | |

Note: In rinse processes, water from rinse (5) was sent under pressure to a reverse osmosis film, and water transmitted the film was fed in rinse (5) bath, although the condensed water which did not transmit the film was returned to rinse (4) bath to reuse. In order to shorten the crossover time between respective rinse processes, blades were provided between respective baths, through which blade processing solution passed.

The composition of each processing solution is as followed, respectively:

| | Tank Solution |
|---|---|
| Color-developer | |
| Water | 800 ml |
| Ethylenediaminetetraacetic acid | 1.5 g |
| Sodium triisopropylnaphthalene-(β)sulfonate | 0.01 g |
| Disodium 1,2-dihydroxybenzene-4,6-disulfonate | 0.25 g |
| Potassium bromide | 0.03 g |
| Triethanolamine | 5.8 g |
| Potassium chloride | 10.0 g |

-continued

| | Tank Solution |
|---|---|
| Potassium carbonate | 30.0 g |
| Sodium hydrogencarbonate | 5.3 g |
| Sodium sulfite | 0.14 g |
| 4-Amino-3-methyl-N-ethyl-N-(4-hydroxybutyl)aniline·2·p-toluenesulfonic acid | (a) 14.5 g (b) 8.00 g |
| Disodium N,N-bis(sulfonatoethyl)-hydroxylamine | 7.4 g |
| Fluorescent whitening agent (UVITEX CK, made by Ciba Geygy Co.) | 2.5 g |
| Water to make | 1000 ml |
| pH (25° C.) | 10.30 |
| Bleach-fixing solution | |
| Water | 400 ml |
| Ammonium thiosulfate (700 g/l) | 100 ml |
| Sodium sulfite | 17 g |
| Iron (III) ammonium ethylenediaminetraacetate | 55 g |
| Disodium ethylenediaminetetraacetate | 5 g |
| Ammonium bromide | 40 g |
| Water to make | 1000 ml |
| pH (25° C.) | 6.0 |
| Rinse solution | |
| (Both tank solution and replenisher) Ion-exchanged water (each ion of calcium and magnesium was 3 ppm or less) | |

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for forming a color image using a silver halide color photographic material having, on a support, at least three silver halide photosensitive layers that are different in color sensitivity and that contain, respectively, couplers capable of forming yellow, magenta, and cyan and at least one non-photosensitive layer, which comprises subjecting said silver halide color photographic material, wherein at least one colorless and non-color-forming compound represented by formula (I) shown below is contained in at least one of the non-photosensitive layers of said silver halide color photographic material, to scanning exposure with a laser, the exposure time being $10^{-4}$ sec or less per picture element, and processing said exposed silver halide color photographic material with a color developer:

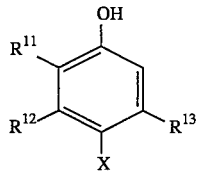

(I)

wherein X represents a hydrogen atom, a hydroxyl group, an amino group, or a sulfonamido group, $R^{11}$ and $R^{12}$ each represent the group defined for X, or an alkyl group, an aryl group, an amido group, a ureido group, an alkylthio group, an arylthio group, an alkoxy group, or an aryloxy group, or $R^{11}$ and $R^{12}$ may together form a carbocyclic ring or a heterocyclic ring; when X represents a hydrogen atom, $R^{11}$ represents a hydroxyl group, an amino group, or a sulfonamido group; and $R^{13}$ represents a hydrogen atom, a halogen atom, a sulfo group, a carboxyl group, an alkyl group, an acyl group, an oxycarbonyl group, a carbamoyl group, a sulfonyl group, or a sulfamoyl group, provided that the molecular weight of the compound represented by formula (I) is 390 or more.

2. The method for forming a color image as claimed in claim 1, wherein silver halide emulsion grains having 95 mol % or more of silver chloride content are contained in at least one silver halide photosensitive layer.

3. The method for forming a color image as claimed in claim 1, wherein a laser is used as a scanning exposure light source.

4. The method for forming a color image as claimed in claim 1, wherein all the spectral sensitivity maxima of the three silver halide photosensitive layers that are different in color sensitivity are 550 nm or over, and a semiconductor laser is used as a scanning exposure light source.

5. The method for forming a color image as claimed in claim 4, wherein the adjacent spectral sensitivity maxima of photosensitive layers differ from each other by at least 30 nm.

6. The method for forming a color image as claimed in claim 1, wherein the exposure time by a scanning exposure system is $10^{-10}$ to $10^{-4}$ sec per picture element.

7. The method for forming a color image as claimed in claim 1, wherein the exposure time by a scanning exposure system is $10^{-10}$ to $10^{-7}$ sec per picture element.

8. The method for forming a color image as claimed in claim 1, wherein the color development processing time is 25 sec or less and the whole processing time involved from the start of the color development processing to the end of the drying process is 120 sec or less.

9. The method for forming a color image as claimed in claim 1, wherein the compound represented by formula (I) is a compound capable of undergoing a redox reaction with the oxidized product of a color developing agent.

10. The method for forming a color image as claimed in claim 1, wherein the compound represented by formula (I) is selected from the group of compounds represented by the following formula (II) formula (II)

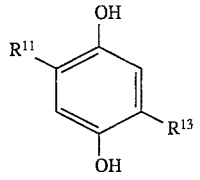

wherein $R^{11}$ and $R^{13}$ have the same meaning as $R^{11}$ and $R^{13}$ in formula (I).

11. The method for forming a color image as claimed in claim 1, wherein X in formula (I) represents a hydroxyl group.

12. The method for forming a color image as claimed in claim 1, wherein $R^{11}$ in formula (I) represents an alkyl group, an amido group, or an alkoxy group.

13. The method for forming a color image as claimed in claim 1, wherein $R^{12}$ in formula (I) represents a hydrogen atom.

14. The method for forming a color image as claimed in claim 1, wherein $R^{13}$ in formula (I) represents a hydrogen atom, an alkyl group, a halogen atom, a carbamoyl group, or a sulfonyl group.

15. The method for forming a color image as claimed in claim 1, wherein the compound represented by formula (I) is used in an amount of 0.05 to 2 mmol/$m^2$ per one layer.

16. The method for forming a color image as claimed in claim 1, wherein a hydrophilic colloid layer containing a white pigment is provided between the support and the photosensitive layer most adjacent to the support of the silver halide color photographic material.

* * * * *